US006419333B2

(12) United States Patent
Liebertz et al.

(10) Patent No.: US 6,419,333 B2
(45) Date of Patent: Jul. 16, 2002

(54) KNOCK-DOWN VERTICAL FILE

(75) Inventors: Frederick C. Liebertz, Twin Lake; Mark A. Powell, West Olive, both of MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 09/853,525

(22) Filed: May 11, 2001

Related U.S. Application Data

(62) Division of application No. 09/428,079, filed on Oct. 27, 1999, now Pat. No. 6,231,141, which is a division of application No. 08/946,104, filed on Oct. 2, 1997, now Pat. No. 6,007,170.

(51) Int. Cl.[7] ..... A47B 88/00
(52) U.S. Cl. ..... 312/348.4; 312/348.1
(58) Field of Search ..... 312/348.1, 348.2, 312/348.4, 257.1, 263, 265.5, 258, 265.6; 220/4.28, 4.32; 403/329

(56) References Cited

U.S. PATENT DOCUMENTS

| | | | | |
|---|---|---|---|---|
| 1,290,743 A | * | 1/1919 | Herpst et al. | 312/348.4 |
| 1,352,002 A | * | 9/1920 | Jones | 312/348.4 |
| 3,024,075 A | * | 3/1962 | Howe | 312/348.4 |
| 3,511,550 A | | 5/1970 | Hilfinger et al. | |
| 4,173,379 A | * | 11/1979 | van der Heiden et al. | 312/348.1 |
| 4,290,658 A | | 9/1981 | De Rosa | |
| 4,561,706 A | | 12/1985 | Grati | |
| 4,887,874 A | | 12/1989 | Joffe | |
| 5,161,870 A | | 11/1992 | Mason et al. | |
| 6,056,380 A | * | 5/2000 | Nien | 312/348.1 |

FOREIGN PATENT DOCUMENTS

| | | | | |
|---|---|---|---|---|
| CH | 658171 | * | 10/1986 | 312/348.1 |
| GB | 809875 | * | 3/1959 | 312/348.4 |
| GB | 2071995 | * | 9/1981 | 312/348.1 |
| IT | 336100 | * | 9/1936 | 312/348.2 |

* cited by examiner

*Primary Examiner*—Janet M. Wilkens
(74) *Attorney, Agent, or Firm*—Flynn, Thiel, Boutell & Tanis, P.C.

(57) ABSTRACT

A knock-down file cabinet and in particular, a vertical file cabinet wherein both the cabinet housing and each of the drawers have a knock-down construction. The drawers use either separate components that are slidably fitted together, or a single sheet of material that defines the bottom, side and back walls. Each drawer construction is usable within the cabinet housing so as to define a complete knock-down vertical file cabinet which can be readily shipped in a relatively, compact container or package and thereafter assembled together.

23 Claims, 22 Drawing Sheets

KNOCK-DOWN VERTICAL FILE

CROSS REFERENCE TO RELATED APPLICATIONS

This is a division of U.S. Ser. No. 09/428,079, filed Oct. 27, 1999, now U.S. Pat. No. 6,231,141 which is a division of U.S. Ser. No. 08/946,104, filed Oct. 2, 1997 now U.S. Pat. No. 6,007,170.

FIELD OF THE INVENTION

The invention relates to a vertical file cabinet and more particularly, a vertical file cabinet having a "knock-down" construction which is shippable in a disassembled or "knocked-down" condition and is readily assembled together for use.

BACKGROUND OF THE RELATED ART

Vertical file cabinets include a hollow upright housing which is open at the front so as to receive a plurality of file drawers therein in a vertically stacked arrangement. Such cabinets are well known and typically use fasteners such as screws or the like or other connection methods such as welding to assemble the individual cabinet components together to form the housing and the drawers. These pre-assembled cabinets are thereafter shipped to customers or distributors.

It is also known to form file cabinets from readily assembleable components which can be shipped in a disassembled condition and are then readily assembled by a customer or distributor. Such cabinets are commonly referred to as "knock-down" cabinets since the component parts can be readily assembled and disassembled. These knock-down file cabinets typically are shipped in smaller packages and at less expense than a preassembled file cabinet.

In one example of a knock-down cabinet, U.S. Pat. No. 1,805,019 discloses a cabinet wherein the side walls, back and top walls of the cabinet are held together by interlocking corner connections. Nevertheless, these corner connections include separate connector parts welded to the top and back walls. For example, the back wall includes vertically elongate bent strips which are welded along the vertical edges of the back wall and are engaged with corresponding rear channels on the side panels or walls. Thus, welding is used to construct the connectors, strips and flanges for connecting the side, back and top walls together.

In another example, U.S. Pat. No. 1,523,653 discloses a knock-down metal cabinet wherein the side, back and top walls are interfitted together. However, two different constructions are provided for the side walls, namely a left side wall and a right side wall. The back wall is connected to the side walls by inserting the opposite side edges thereof into engagement with corresponding slots on the side walls. The slots extend vertically along the entire height of the side walls. This cabinet, however, does not include non-handed side walls which are usable on either the left or right sides, or a connection between the back and side walls which only requires a minimum of manipulation of the back wall to engage the back and side walls together.

Additionally with respect to the cabinet drawers, it is also known to form the cabinet drawers as "knock-down" drawers. For example, U.S. Pat. No. 4,173,379 discloses a knock-down construction for a card index drawer wherein the bottom, side, front and back walls are joined one with the other along edges thereof. More particularly, the walls are joined together by slots on one side wall which cooperate with corresponding slots on a second wall for providing connections between the horizontal and vertical edges of the walls. Also, U.S. Pat. No. 4,462,647 illustrates similar cooperating slots to join bottom and side walls together along horizontal edges thereof.

In a further example, U.S. Pat. No. 1,352,002 discloses the connection of side walls to a bottom wall by cooperating horizontal slots, the connection of a back wall to the side walls by fasteners and the use of a two-piece front wall which includes outer and inner panels. The panels are held together by a spring on the bottom edges thereof.

In still further examples of a second type of a drawer, U.S. Pat. Nos. 3,511,550, 3,639,027, 3,759,600, 4,290,658, 4,561,706 and 4,887,874 disclose various drawer constructions wherein several of the bottom and side walls are formed from a single sheet of material.

The invention relates to a knock-down file cabinet and in particular, a vertical file cabinet wherein both the cabinet housing and each of the drawers have a knock-down construction.

Generally, the cabinet housing includes back, side and top walls which define a box-like enclosure and a ladder-like drawer support frame which defines a plurality of rectangular vertically stacked openings at the front of the cabinet. Two of the side walls are joined together in laterally spaced relation by the back wall and the drawer support ladder, and the top wall is secured thereto. The drawer support ladder is positioned at the front of the cabinet housing to define the openings through which each individual drawer is slidably received.

More particularly, the back wall has upturned clips or tabs which are vertically spaced apart along one side edge thereof and downturned tabs along the opposite side edge thereof. The tabs serve to connect the rear vertical edges of the side walls to the opposite vertical edges of the back wall to define the rear corners of the cabinet. The two side walls have an identical non-handed construction, and the rear vertical edge of each side wall includes a plurality of vertically spaced apertures which are adapted to receive the corresponding clips or tabs of the back wall.

During assembly, the back wall is moved laterally towards the left side wall until the downturned tabs are received through the apertures and then the back wall is shifted downwardly a short distance so that the tabs clip over the lower edge of the openings. The right side wall is similarly engaged with the back wall except that the tabs on the right edge of the back wall project upwardly. In particular, the right side wall is moved laterally and then shifted downwardly until the upturned tabs engage the corresponding openings in the right side wall.

The front vertical edges of the side walls include vertical channels which open rearwardly and are adapted to receive corresponding vertical rails of the drawer support ladder therein. The drawer support ladder rigidly connects the left and right side walls together and defines the open front of the cabinet housing.

As a result, the cabinet housing is rigidly formed from the two non-handed side walls, the back wall, the top wall and the drawer support ladder. A reduced number of components are used and are connected together with a minimum number of fasteners. Thus, the components are readily assembled together.

The knock-down vertical file cabinet of the invention further includes two knock-down drawer constructions for the file drawers. These drawers are slidably received through the openings of the aforementioned drawer support ladder. The first embodiment uses separate components which are slidably fitted together to form the drawer. The second embodiment uses a single sheet of foldable material such as metal which defines the bottom, side and back walls which are all joined together as a single integral piece. To form the box-like drawer, the side walls and back wall are foldable relative to the bottom wall about corresponding fold lines formed therebetween. Either drawer construction is usable within the above-described cabinet housing so as to define a complete knock-down vertical file cabinet which can be readily assembled.

Other objects and purposes of the invention, and variations thereof, will be apparent upon reading the following specification and inspecting the accompanying drawings.

Figure 1:
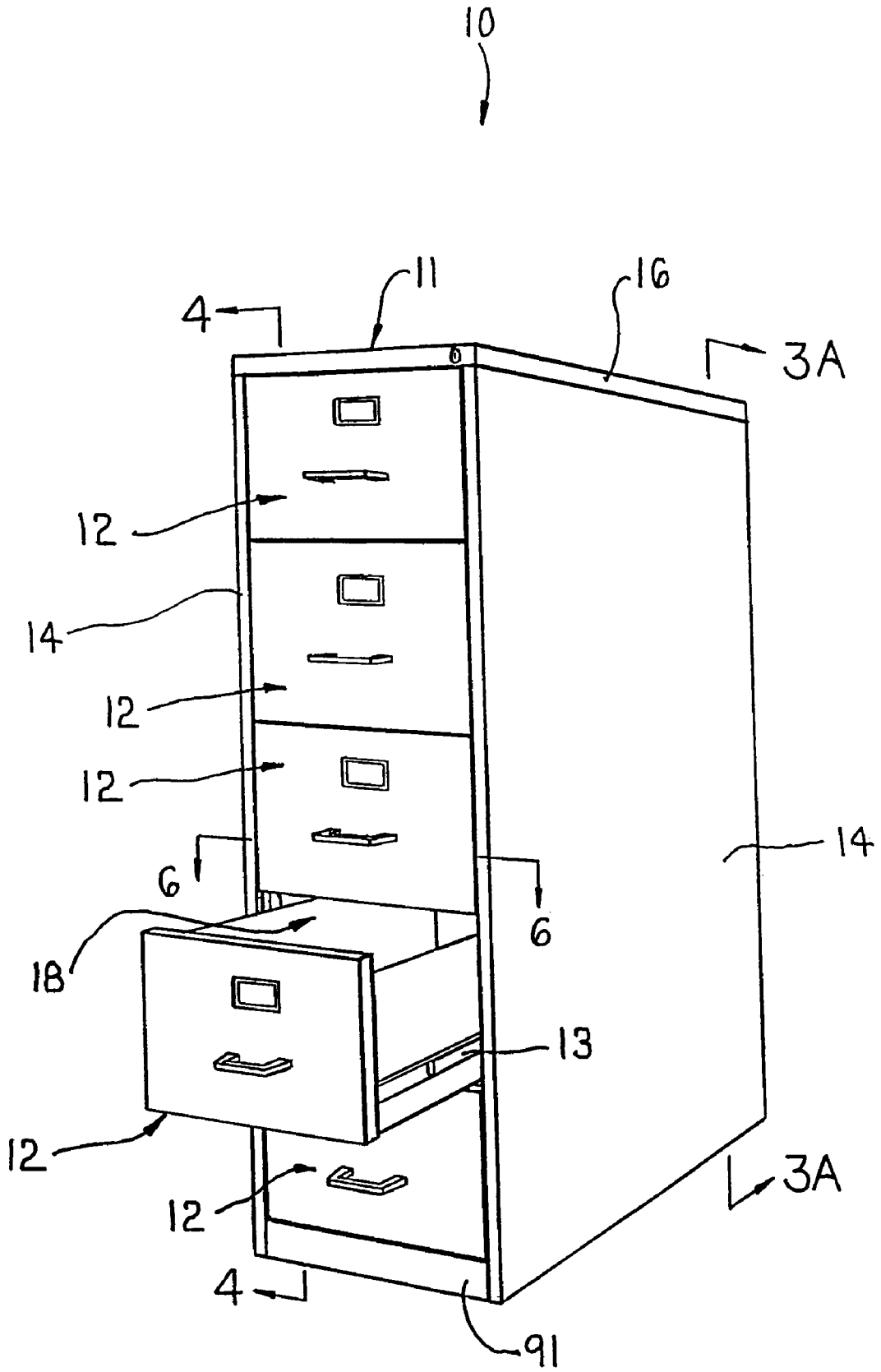
FIG. 1 is a front perspective view of a knock-down vertical file cabinet of the invention with one drawer in an open position.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION OF THE INVENTION

Referring generally to FIG. 1, the invention relates to a knock-down file cabinet 10, preferably a vertical file cabinet, which includes a box-like cabinet housing or enclosure 11 that has an open front side thereof, and a plurality of slidable cabinet drawers 12 which are slidably received through the open cabinet front. Both the cabinet housing 11 and the cabinet drawers 12 have a construction which is commonly referred to as a "knock-down" construction which allows for ready assembly and disassembly thereof. More particularly, the knock-down cabinet housing 11 is illustrated in FIGS. 1–7 while a first knock-down drawer embodiment 12-1 is illustrated in FIGS. 8–17, a second drawer embodiment 12-2 is illustrated in FIGS. 18–25 and a third embodiment 12-3 is illustrated in FIG. 26.

Generally, the knock-down cabinet housing 11 and cabinet drawers 12-1, 12-2 and 12-3 are constructed of separable components as described in more detail hereinafter which can be readily assembled and disassembled. To reduce the costs associated with shipping the file cabinet 10 which normally would be greater for a conventional preassembled cabinet (not illustrated), the components of the cabinet housing and one of the cabinet drawers 12-1, 12-2 and 12-3 are shipped together in a disassembled condition which allows for a more compact package or container. Thereafter, the components of the housing 11 and cabinet drawers 12-1, 12-2 or 12-3 are readily assembled together.

Figure 2:
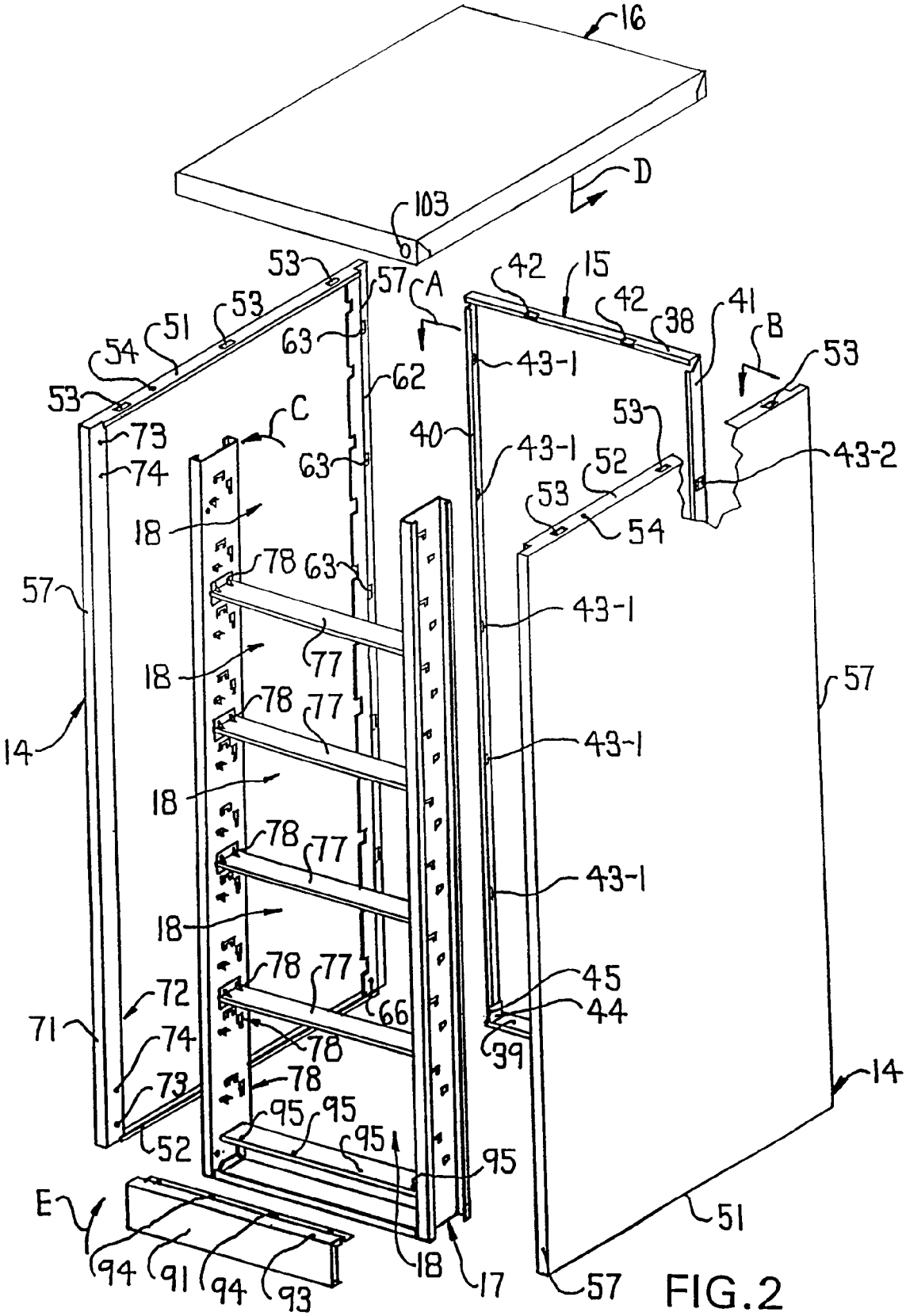
FIG. 2 is an exploded perspective view of a cabinet housing of the vertical file cabinet illustrated with the drawers removed.

Generally with respect to the cabinet housing 11 illustrated in FIGS. 1–7, the cabinet housing 11 is formed from a pair of identical left and right side walls 14, a back wall 15, a top wall 16 and a drawer support ladder 17 (FIG. 2). The drawer support ladder 17 defines a plurality of vertically stacked openings 18 for receiving the drawers 12 therein. The side walls 14, back wall 15 and top wall 16 are readily interlocked together along vertical and horizontal edges thereof into a hollow box-like arrangement using only a minimum of fasteners.

With respect to the embodiments of the drawer 12, the drawer 12-1 (FIGS. 8–17) includes a pair of identical side walls 21, a bottom wall 22, a back wall 23 and a two-piece front wall 24. As will be discussed in more detail, the walls 21, 22, 23 and 24 are separate components and include interfitting flanges and tabs which allow for the assembly of the drawer 12-1 by only using two fasteners 25 in the front wall 24.

The second embodiment 12-2 (FIGS. 18–25) generally is formed of a single sheet 28 of material which includes perforated fold lines 29 to define a central bottom wall 30, left and right side walls 31 and a back wall 32 which are integrally joined together. The side walls 31 and back wall 32 are foldable upwardly and are interlocked together along the left and right back corners 33 of the drawer 12-2. Thereafter, a front wall 34 is connected to the bottom wall 30 and side walls 31 to complete the assembly of the drawer 12-2 as described in more detail hereinafter. The third embodiment of the drawer 12-3 also uses a knock-down construction. In view thereof, all of the cabinet housing 11, drawer 12-1, drawer 12-2 and drawer 12-3 have a knock-down construction.

Generally with respect to the cabinet housing 11 of FIGS. 1–7 and the assembly thereof, the side walls 14, back wall 15 and top wall 16 are each formed of a single sheet of sheet metal without using additional fasteners or welding. This thereby reduces the time and expense in forming the side walls 14, back wall 15 and top wall 16. Additionally, since the side walls 14 are formed identically, only one particular construction for the side walls 14 is required which eliminates the expense of having two different side walls for the left and right sides of the housing 11.

To assemble the aforementioned cabinet components together as generally indicated in FIG. 2, the housing 11 uses a clip and aperture arrangement which will be described in more detail hereinafter. As a result, assembly of the cabinet housing 11 is accomplished by moving the back wall 15 laterally to the left and then downwardly as indicated by arrow A to effect a connection therebetween, and thereafter similarly moving the right side wall 14 laterally to the left and then downwardly as indicated by arrow B. Thereafter, the drawer support ladder 17 is engaged with the front edges of the side walls 14 by pivoting the ladder 17 forwardly about a lower end thereof as indicated by arrow C. The top wall 16 is engaged with the top edges of the left and right side walls 14 and the back wall 15 by moving the top wall 16 downwardly and then to the rear as indicated by arrow D. Lastly, the lower end of the ladder 17 is enclosed by a cover 91 which is pivoted rearwardly about a lower edge thereof as indicated generally by arrow E into engagement with the ladder 17.

Figure 3A:
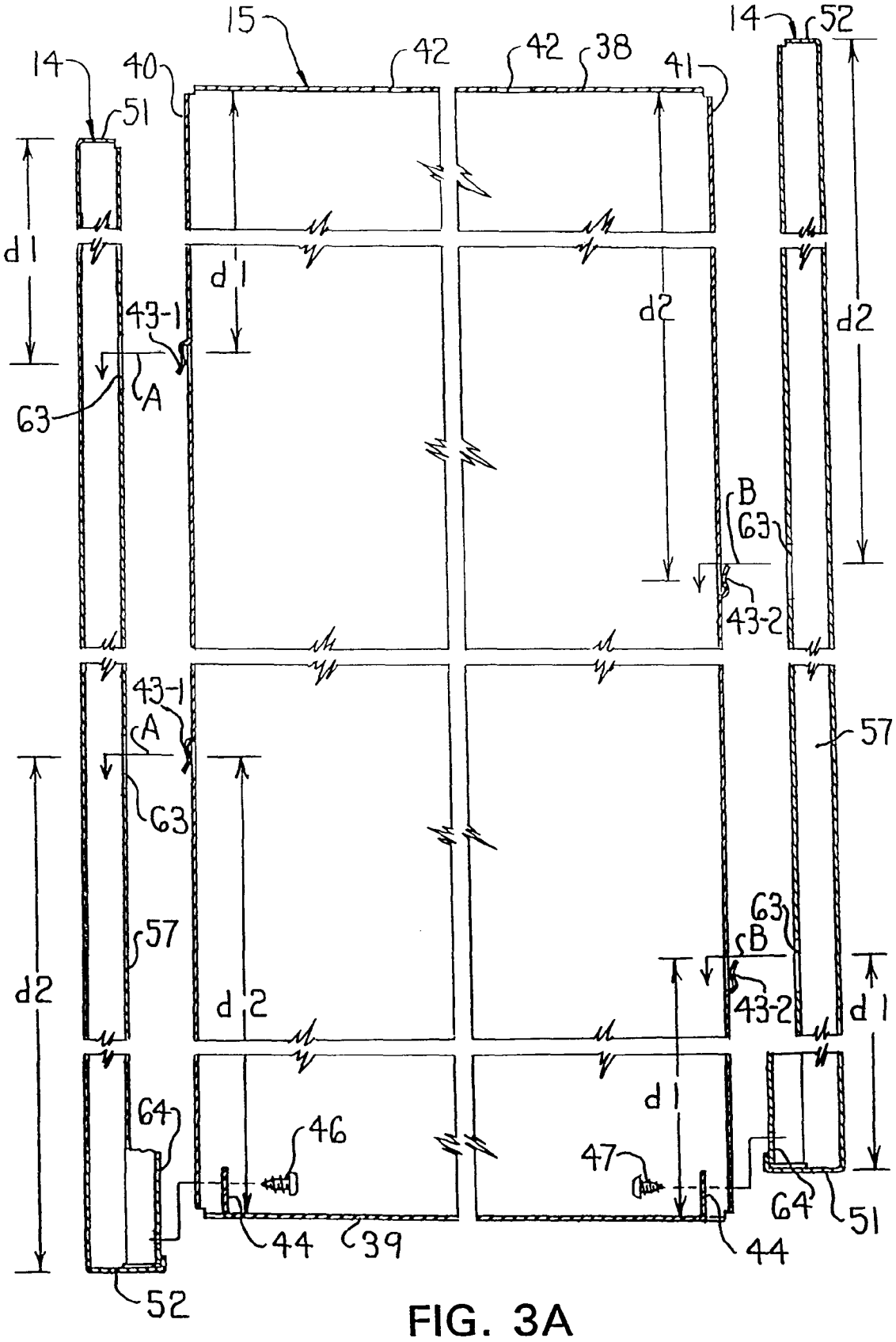
FIG. 3A is an exploded front elevational view in cross section as viewed in the direction of arrows 3A—3A of FIG. 1.
Figure 3B:
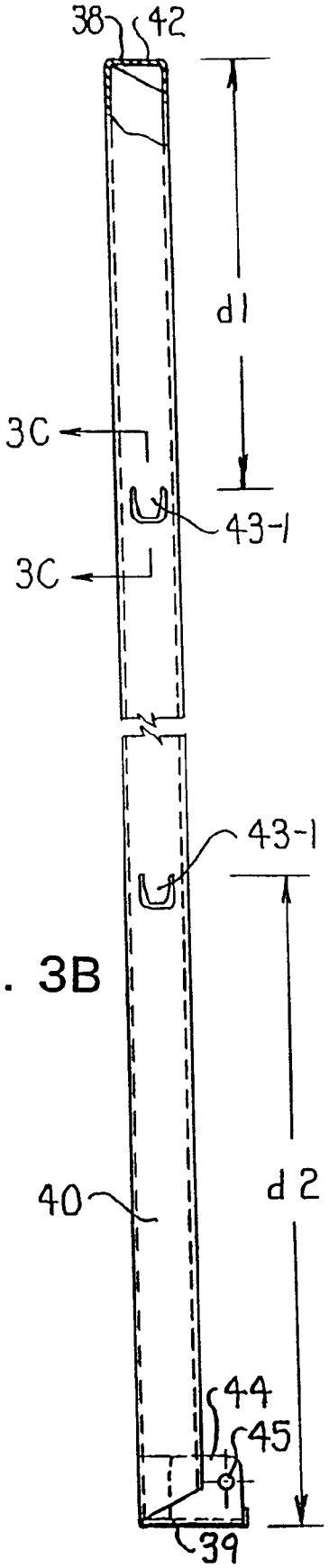
FIG. 3B is a left side elevational view in partial section of the back wall.

Referring to FIGS. 2, 3A and 3B, the back wall 15 is formed of a planar generally rectangular piece of sheet metal material. The material is bent to form top and bottom edge flanges 38 and 39 respectively which extend horizontally, and left and right edge flanges 40 and 41 respectively which extend vertically to define a rectangular peripheral edge of the back wall 15. To interlock the top wall 16 to the back wall 15, the top edge flange 38 includes a pair of laterally spaced apart upper notches 42 which extend over a corner edge so as to open both forwardly and upwardly therethrough.

Figure 3C:
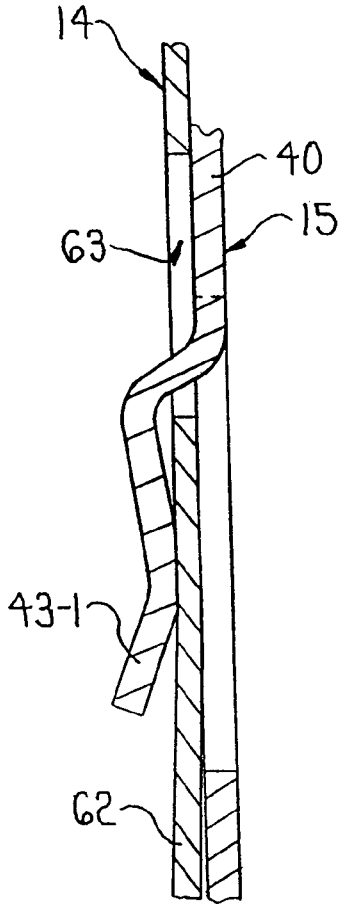
FIG. 3C is an enlarged partial front view in cross section of a connector tab of the back wall engaged with a left side wall as taken along line 3C—3C of FIG. 3B.

To connect the side walls 14 to the back wall 15, the left and right edge flanges 40 and 41 are each formed with a plurality and preferably five vertically spaced apart connector tabs or clips 43-1 and 43-2 respectively. The connector tabs 43-1 and 43-2 project outwardly so as to be engagable with a respective one of the side walls 14. While the respective connector tabs 43-1 and 43-2 on both the left and right edge flanges 40 and 41 have the same cross sectional shape as seen in FIGS. 3A and 3C and serve the same function for connecting the respective side wall 14 thereto, the connector tabs 43-1 on the left edge flange 40 project downwardly while the connector tabs 43-2 on the right edge flange 41 project upwardly.

Additionally, while all of the connector tabs 43-1 and 43-2 are vertically spaced equidistantly from one another, the left edge connector tabs 43-1 are offset vertically with respect to the right edge connector tabs 43-2. More particularly, as seen in FIGS. 3A and 3B, the uppermost connector tab 43-1 of the left edge flange 40 is spaced the distance d1 from the top edge flange 38 while the lowermost tab 43-1 thereof is spaced upwardly a distance d2 from the bottom edge flange 39. Conversely, the uppermost connector flange 43-2 of the right edge flange 41 is spaced the distance d2 from the top edge flange 38 while the lowermost tab 43-2 thereof is spaced the distance d1 from the bottom edge flange 39. Thus, the tabs on the left and right edge flanges 40 and 41 project in opposite vertical directions and are vertically offset one with respect to the other. The tabs 43-1 and 43-2 allow for interlocking of the respective left and right side walls 14 to the back wall 15.

To prevent dislodgement of the side walls 14 from the back wall 15, the bottom edge flange 39 of the back wall 15 includes a pair of upstanding locking flanges 44 which are located near the respective left and right edge flanges 40 and 41. Each locking flange 44 includes an aperture 45 which opens sidewardly and engages a screw 46 or other suitable fastener as will be described in more detail herein.

The housing 11 also includes two of the side walls 14 which are identical so as to reduce the number of component parts required for the cabinet housing 11. In particular, each side wall 14 is usable either on the left or right side with the right side wall 14 being rotated 180° about a central horizontal axis relative to the left side wall 14.

Each side wall 14 includes a first horizontal flange 51 and a second horizontal flange 52 which are vertically spaced apart to define the top and bottom edges of the side wall 14. In particular, the first and second horizontal flanges 51 and 52 respectively define the upper and lower edges of the left side wall 14 and are reversed in the right side wall 14 so as to define the respective lower and upper edges thereof as seen in FIG. 2.

Each of the first and second horizontal flanges 51 and 52 includes three apertures 53 which open vertically therethrough and are horizontally spaced apart. The apertures 53 on the upper flange 51 of the left side wall 14 and the upper flange 52 of the right side wall 14 secure the top wall 16 to the side walls 14.

To prevent dislodgement of the top wall 16, each of the horizontal flanges 51 and 52 also includes a screw hole 54 opening vertically therethrough which is located near the front of the side walls 14 and engages a screw 56 (FIG. 4) or other suitable fastener. When assembling the cabinet housing 11, only the apertures 53 on the uppermost edges of the side walls 14 are used.

Figure 5:
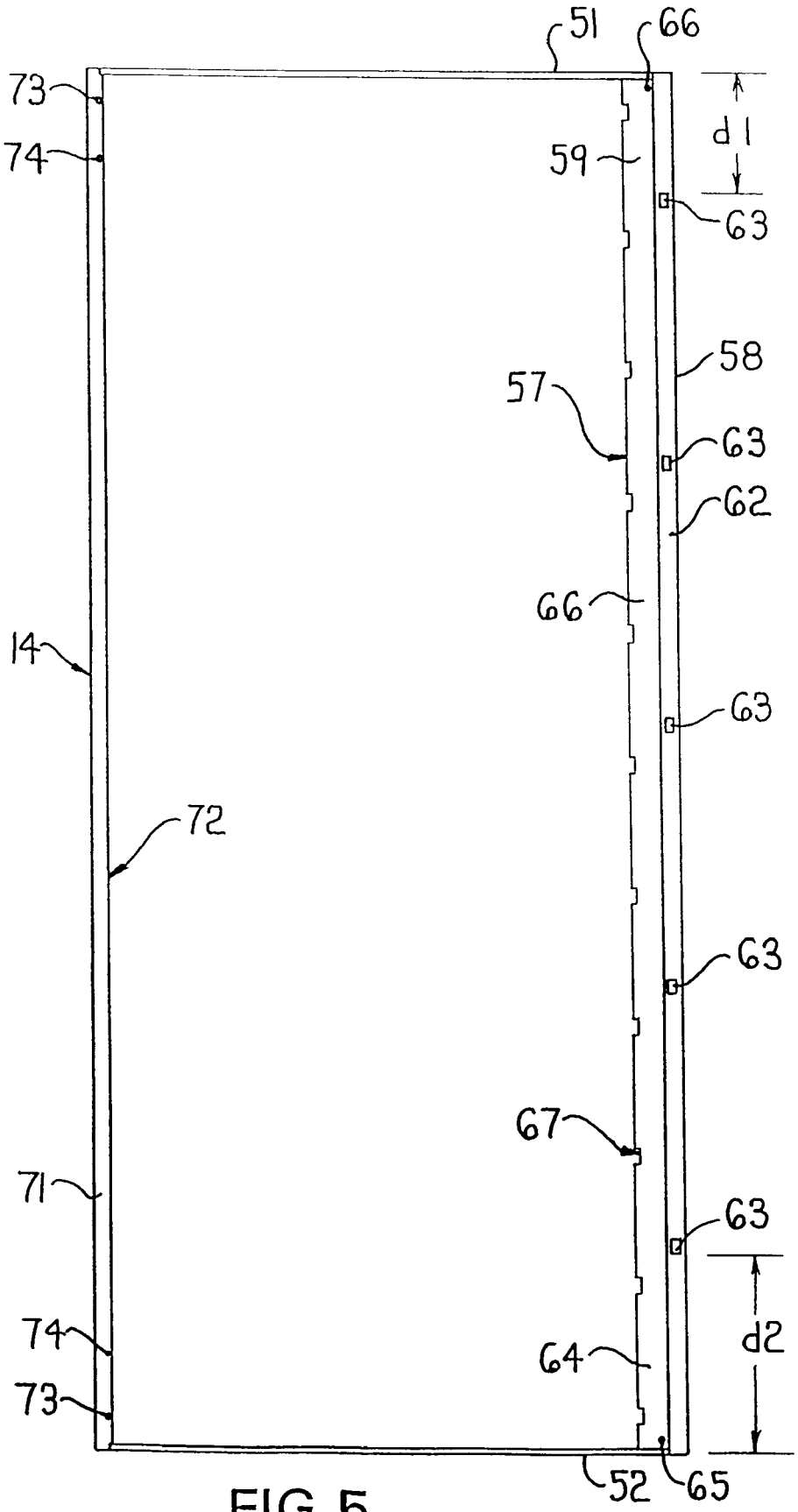
FIG. 5 is a side elevational view of a side wall as oriented for use as the left side wall.
Figure 6:
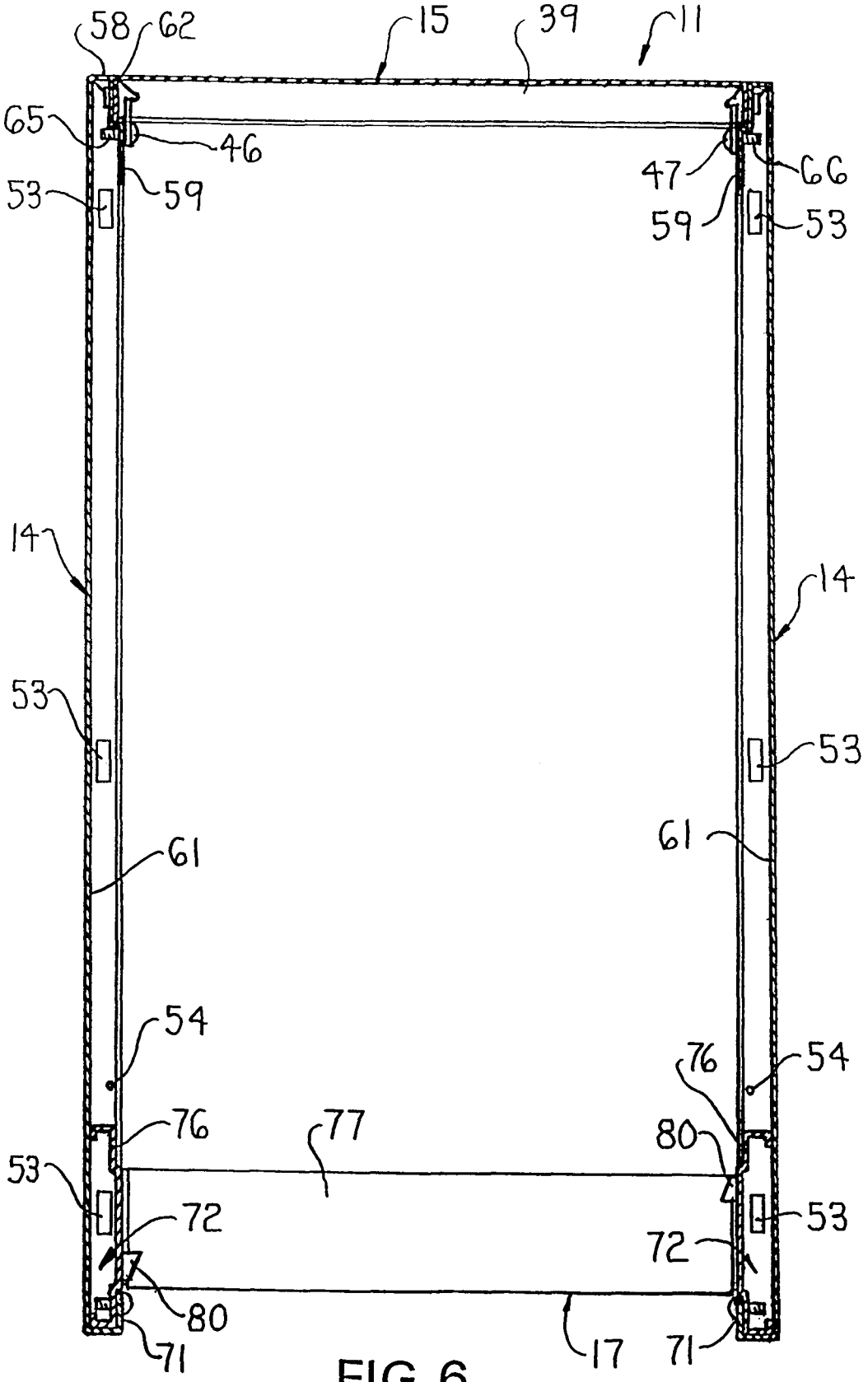
FIG. 6 is a top plan view in cross section of the cabinet housing as taken along line 6—6 of FIG. 1 illustrated with the drawers removed.
Figure 7:
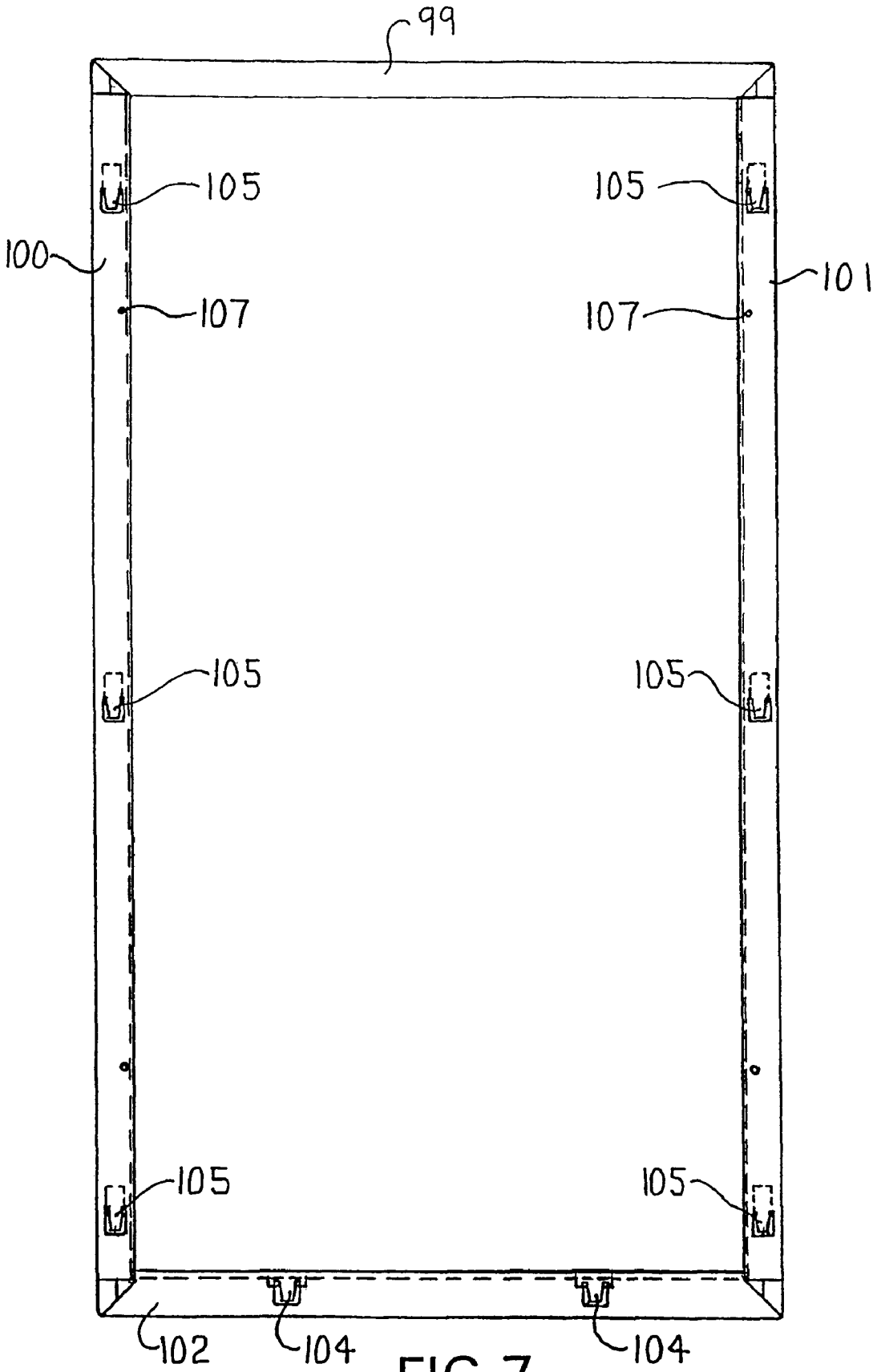
FIG. 7 is a bottom view of a top wall of the cabinet housing.

Each side wall 14 also includes a rear edge flange 57 which extends vertically between the top and bottom as generally illustrated in FIG. 2. Referring more particularly to FIGS. 5 and 7, the side walls 14 are bent along a rear edge thereof to define the rear edge flange 57. The rear edge flange 57 has a rearward facing surface 58 defining a rear vertical corner of the side wall 14, and an inward facing stepped section 59. The stepped section 59 extends forwardly from the rearward facing surface 58 and is spaced inwardly from a side wall surface 61.

To effect connection of the side walls 14 to the back wall 15, the stepped section 59 is divided into a rear portion 62 which is formed with five rectangular apertures or open cut-outs 63 in vertically spaced relation, and a front portion 64 which is joined to the rear portion 62.

With respect to the rear portion 62, the cut-outs 63 are formed in substantially the same vertically spaced relation as the connector tabs 43-1 of the left edge flange 40. For example, with respect to the left side wall 14, the uppermost aperture 63 of the left side wall 14 is spaced downwardly from the flange 51 the distance d1 while the lowermost aperture 63 is spaced upwardly from the flange 52 the distance d2. As a result, the back wall 15 is connected to the left side wall 14 by moving the back wall 15 leftwardly until the connector tabs 43-1 are inserted through the corresponding apertures 63 of the side wall 14 and thereafter, the back wall 15 is shifted downwardly so that the apertures 63 of the side wall 14 are tight-fittingly engaged by the connector tabs 43-1 as can be seen in FIG. 3C. The leftward and downward shifting of the back wall 15 is indicated generally by reference arrows A (FIGS. 2 and 3A). Thus, the back wall 15 can be interconnected to the left side wall 14 with a minimum of horizontal and vertical shifting.

Since the apertures 63 of the side wall 14 are formed in the same vertically spaced configuration as the connector tabs 43-1, the second side wall 14 is pivoted 180° about the horizontal central axis thereof to define the right side of the housing 11. Thus, the apertures 63 on the left and right side wall 14 are vertically offset so that the apertures 63 on the right side wall 14 are aligned with the connector tabs 43-2 of the back wall 15. The right side wall 14 is joined to the back wall 15 by shifting the right side wall 14 leftwardly and downwardly as indicated by arrows B (FIGS. 2 and 3A). As a result, the connector tabs 43-2 are inserted through the apertures 63 and then engaged with the right side wall 14.

To prevent dislodgement of the interconnected left and right side walls 14 and back wall 15, the front portion 64 of the rear side wall flange 57 includes screw holes 65 and 66 (FIG. 5) that are located near the edge flanges 51 and 52. The lower screw hole 66 of the left side wall 14 is located so as to be coaxially aligned with the left locking flange 44 of the back wall 15. Since the right side wall 14, however, is rotated 180° relative to the left side wall 14, the other screw hole 65 is positioned adjacent the right locking flange 44 of the back wall 15. The fasteners 46 and 47 (FIG. 3A) thereafter are threadingly engaged through the respective left and right locking flanges 44 and the corresponding screw holes 66 and 65 of the side walls 14. Thus, the left and right side walls 14 and back wall 15 are fixedly joined together by simple manipulation of the components and by the subsequent engagement of the screws 46 and 47.

To mount a rearward end of the drawer slides 13 to a respective one of the side walls 14, the front flange portion 64 also includes a plurality of vertically spaced notches 67. A rearward end of the drawer slide 13 is seated with a corresponding one of the notches 67 while a forward end thereof is supported by the drawer support ladder 17 as discussed in more detail hereinafter.

To secure the drawer support ladder 17 to the side walls 14, each side wall 14 further includes a forward edge flange 71 (FIGS. 4–6) which defines a vertical front corner of the cabinet housing 11. The forward edge flange 71 defines a vertical channel 72 extending along the entire vertical height thereof. The vertical channel 72 opens rearwardly so as to receive the drawer support ladder 17 therein. To fixedly secure the drawer support ladder 17 in place, the front edge flange 71 includes two pairs of apertures 73 and 74 near the top and bottom thereof.

Once the side walls 14 and back wall 15 are secured together, the drawer support ladder 17 is rigidly secured to the forward edge flanges 71 of the left and right side walls 14. Generally, the drawer support ladder 17 includes a pair of laterally spaced vertical rails 76 which are received in the channels 72. The rails 76 are joined together in a ladder-like arrangement by a plurality of horizontal cross members 77. The cross members 77 have welding flanges 78 on the opposite ends thereof, and are welded to the vertical rails 76 in a vertically spaced relation so as to define a plurality, and preferably five rectangular drawer openings 18 which are adapted to slidably receive the cabinet drawers 12 therethrough.

Figure 4:
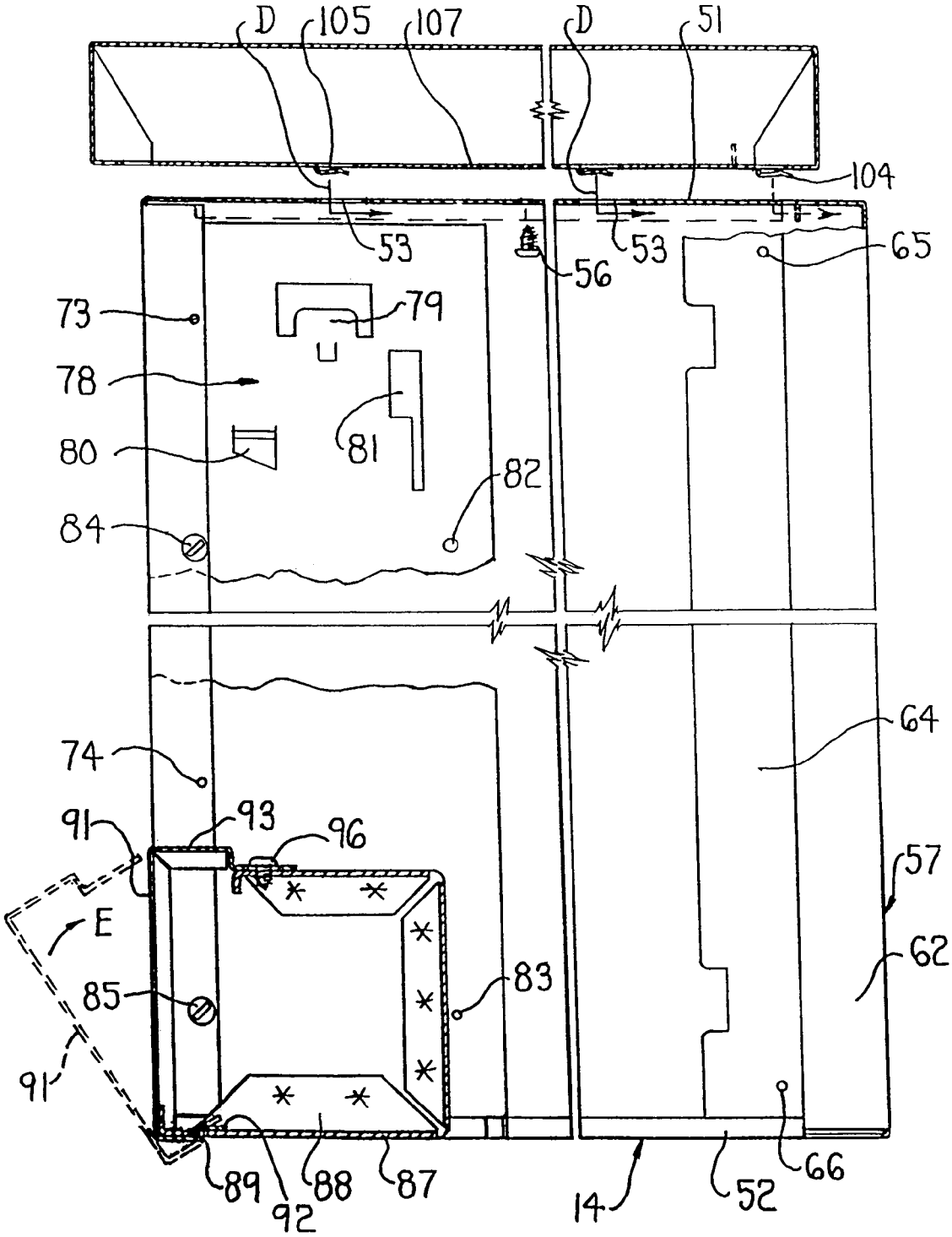
FIG. 4 is an exploded side elevational view in broken cross section as taken along line 4—4 of FIG. 1.

More particularly with respect to the construction of the drawer support ladder 17, the vertical rails 76 are formed identical to each other to minimize the number of parts required. Referring to FIGS. 2, 4 and 7, the rails 76 have a substantially C-shaped cross section when viewed from above and have a lateral thickness which permits a forward edge of each rail 76 to be slidably inserted into the rearward opening vertical channel 72 of the side walls 14.

Each rail 76 includes aperture groupings generally designated by reference numeral 78 which are provided to support the drawer slides 18, a drawer latch (not illustrated) of conventional construction, and a cabinet locking assembly (not illustrated) also of conventional construction. Two aperture groupings 78 are provided on each side of each drawer opening 18 to provide upper and lower mounting locations to support either one large drawer or two small drawers in each opening 18. For example, the opening 18 can be provided with a 12 inch high drawer, or two 6 inch high drawers.

More particularly with respect to the aperture groupings 78 as generally seen in FIG. 4, each aperture grouping 78 includes a connector tab 79 for a drawer slide 13, a catch 80 for a drawer latch (not illustrated) and a slot 81 for a drawer lock (not illustrated).

The drawer slide connector tab 79 is an upwardly extending tab of conventional construction and is adapted to engage a front end of the drawer slide 13. Thus, each drawer slide 13 is supported at its front end by the drawer slide connector tab 79 of the rail 76 and its rear end by the corresponding notch 67 formed in the rear flange 57 of the side wall 14. Since two aperture groupings 78 and accordingly, two drawer slide connector tabs 79 are provided on each side of each drawer opening 18, one or two drawer slides 13 can be provided to support 12" or 6" drawers.

The drawer latch projection 80 is a triangular formation which is bent inwardly from the vertical rail 76 and is adapted to engage a thumb latch assembly (not illustrated) of a drawer 12. The projection 80 and latch assembly are of conventional construction. The drawer lock slot 81 is disposed rearwardly of the drawer latch projection 80 and is adapted to receive a locking mechanism of a conventional drawer lock assembly (not illustrated).

The cabinet 10 preferably is provided with the thumb latch assembly (not illustrated) engaging the left side of the drawer support ladder 17 while the drawer lock assembly (not illustrated) engages the right side thereof. Thus, in the particular left side aperture grouping 78 illustrated in FIG. 4, only the drawer slide connector tab 79 and the drawer latch projection 80 are used. The drawer lock slot 81 illustrated in FIG. 4 is not utilized since the drawer lock assembly (not illustrated) is provided on the other side of the drawers 12. Since the vertical rails 76 are identical, however, a corresponding aperture grouping 78 also is formed in the right side vertical rail 76 although in an opposite orientation. It is the drawer lock slot 81 on the right side vertical rail 76 which is used for engagement with the conventional drawer lock assembly (not illustrated).

To secure the ladder 17 to the side walls 14, each vertical rail 76 also includes an upper pair of apertures 82 (FIG. 4). One upper aperture 82 is disposed close to the front rail edge and the second upper aperture 82 is disposed adjacent the rear rail edge. A lower pair of apertures 83 also are formed through each rail 76 adjacent the front and rear rail edges similar to the upper apertures 82. Accordingly, when the vertical rails 76 are inserted into the respective vertical channels 72, the forwardmost upper aperture 82 is coaxially aligned with the uppermost aperture 74 of the side wall 14 and receives a fastener 84 therethrough to lock the rail 76 in position. Also, the lower aperture 83 closest to the front rail edge is coaxially aligned with the lowermost aperture 73 of the side wall 14 to receive a lower fastener 85 therethrough. As a result, the front edges of the side walls 14 are rigidly secured together by the ladder 17.

The lower end of the drawer support ladder 17 further includes a C-shaped horizontal channel 87 (FIGS. 2 and 4). The opposite ends of the channel 87 include welding flanges 88 which are welded to the vertical rails 76. The front side of the channel 87, however, is open. Thus, the channel 87 includes four laterally spaced slots 89. To enclose the open front side of the channel 87, a C-shaped front cover 91 is provided which includes four stepped tabs 92 that project rearwardly. The stepped tabs 92 are inserted upwardly at an angle through the slots 89 (as generally seen in FIG. 4 in phantom outline), and then the front cover 91 is pivoted rearwardly as indicated by reference arrow E until a rearwardly extending top flange 93 slides over the channel 87. The top flange 93 includes four laterally spaced apertures 94 which are coaxially aligned with corresponding apertures 95 in the bottom channel 87. The apertures 94 and 95 receive four fasteners 96 therethrough to removably secure the front cover 91 in place.

As discussed herein, the four sides of the cabinet 10 thereby are defined by the side walls 14, the back wall 15 and the drawer support ladder 17. The hollow interior defined by these four sides is then enclosed by the top wall 16.

Referring to FIGS. 2, 4 and 7, the top wall 16 is defined by a front edge flange 99, left and right edge flanges 100 and 101 and a back edge flange 102 extending laterally between the left and right edge flanges 100 and 101. The front edge flange 99 faces forwardly and includes a lock aperture 103 which is adapted to receive a lock (not illustrated) of the aforementioned drawer lock assembly (not illustrated). The front edge flange 99 also defines an upper edge of the uppermost drawer opening 18.

To connect the top wall 16 to the remainder of the cabinet housing 11, the back edge flange 102 includes two laterally spaced apart connector tabs 104 which project downwardly and rearwardly for engagement with the corresponding apertures 42 formed in the upper flange 38 of the back wall 15. Additionally, the left and right top edge flanges 100 and 101 each include three spaced apart connector tabs 105 which similarly project downwardly and rearwardly. These tabs 104 and 105 have the same cross sectional shape as the back wall tabs 43-1 and 43-2 (FIG. 3C).

As illustrated in FIG. 4, the top wall 16 is engaged with the side walls 14 and the back wall 15 by lowering the top wall 16 thereon until the side connector tabs 105 are inserted through the apertures 53, and then the top wall 16 is shifted rearwardly until both the rear connector tabs 104 and side connector tabs 105 are engaged with the respective apertures 42 and 53. This downward and rearward shifting of the top wall 16 is generally indicated by reference arrows D in FIGS. 2 and 4.

To prevent dislodgement of the top wall 16, the left and right flanges 100 and 101 further include apertures 107 near the front thereof. The apertures 107 are coaxially aligned with the apertures 54 at the top of the side walls 14 when the top wall 16 is in the engaged position (FIG. 1). Thereafter, the screw 56 (FIG. 4) is screwed into the apertures 54 and 107 to prevent forward sliding of the top wall 16.

In use, the side walls 14, back wall 15, top wall 16, drawer support ladder 17 and front cover 91 can be readily shipped in a compact package in a disassembled condition. Thereafter, the cabinet housing 11 can be readily constructed from the above-identified components.

In particular, the housing 11 is assembled by positioning the back wall 15 next to the left side wall 14 and then shifting the back wall 15 sidewardly and downwardly (as indicated by reference arrow A) until the connector tabs 43-1 engage the apertures 63. The right side wall 14 similarly is shifted laterally towards the back wall 15 and downwardly (as indicated by arrow B) until the corresponding connector tabs 43-2 of the right edge flange 41 are engaged with the apertures 63 of the right side wall 14. The engagement of the side walls 14 and back wall 15 is therefore accomplished with a minimum of lateral and vertical shifting while securely interconnecting the vertical edges of these components. Thereafter, the two screws 46 and 47 are threadingly engaged through the locking flanges 44 of the back wall 15 and the coaxially aligned apertures 66 and 65 of the left and right side walls 14.

To secure the front edges 71 of the side walls 14 together, the lower end of the drawer support ladder 17 is inserted into the channels 72 of the side walls 14. Thereafter, the upper end of the drawer support ladder 17 is swung forwardly (as indicated by reference arrow C) until the entire front edges of the rails 76 are inserted into the channels 72. The drawer support ladder 17 is locked in this engaged position by the upper screws 84 and the lower screws 85. The front cover 91 is connected to the lower end of the ladder 17 by inserting the lower connector tabs 92 into the corresponding slots 89 in the horizontal bottom channel 87 (as illustrated in phantom outline in FIG. 4). Thereafter, the front cover 91 is swung rearwardly (in the direction of arrow E) so as to enclose the front of the channel 87, and is secured in place by fasteners 96.

Lastly, the top wall 16 is moved downwardly and shifted rearwardly (as indicated by reference arrow D) so as to simultaneously move the back connector tabs 104 into the corresponding apertures 42 of the back wall 15 and the side apertures 105 into the corresponding apertures 53 of the side walls 14. The top wall 16 is locked in this engaged position by fasteners 56 (FIG. 4).

As can be seen, the cabinet housing 11 is readily assembled together. In particular, the separate components are interlocked together by simply shifting the components one with respect to the other into engaged positions. The additional fasteners 46, 47, 54, 84, 85 and 96 are merely provided to prevent the engaged components from being dislodged one from the other. Further, only a total of 12 fasteners are provided to secure the various components. Accordingly, the housing 11 can be assembled with relative ease and with a minimal number of component parts.

With respect to the first embodiment of the knock-down cabinet drawer 12-1 illustrated in FIGS. 8–17, the drawer 12-1 is formed of independent separable sheet metal components, namely the left and right side walls 21, bottom wall 22, back wall 23 and front wall 24.

Figure 14:
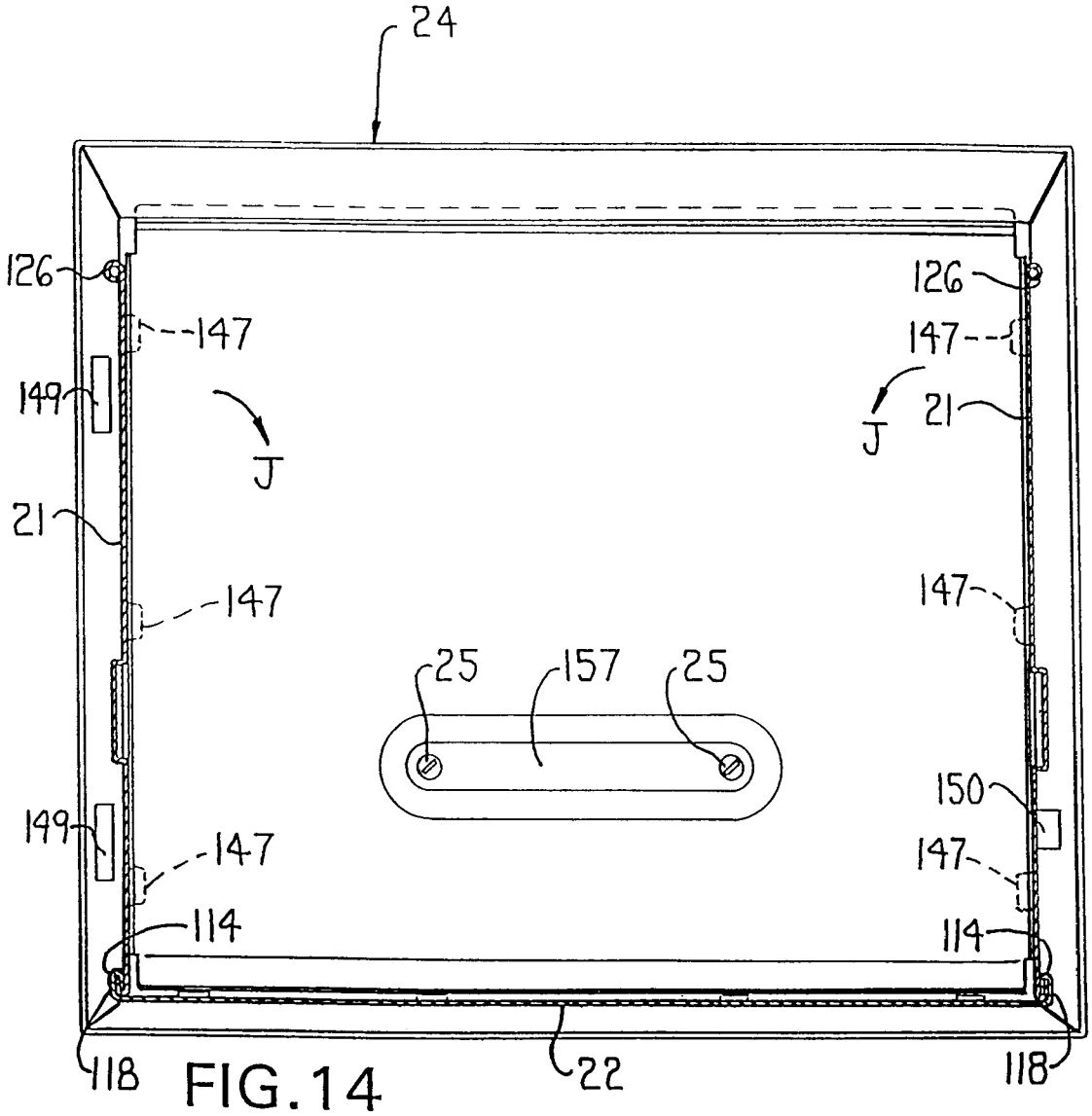
FIG. 14 is a rear elevational view in cross section illustrating an interior surface of the front wall as taken along line 14—14 of FIG. 8.

More particularly with respect to the components of the drawer 12-1, the bottom wall 22 (FIG. 11) is rectangular, and is formed with a central strengthening channel 112 which extends longitudinally along the length thereof. The bottom wall 22 also includes a pair of upstanding side channels 114 (FIGS. 11 and 14) which extend longitudinally along the opposite side edges thereof. The side channels 114 generally have an inverted J-shaped cross section which projects upwardly from the horizontal surface of the bottom wall 22 as generally seen in FIG. 14. More particularly, this inverted J-shaped cross section is open on both an inner side and at the opposite ends thereof so as to slidably mate with the side walls 21.

Figure 11:
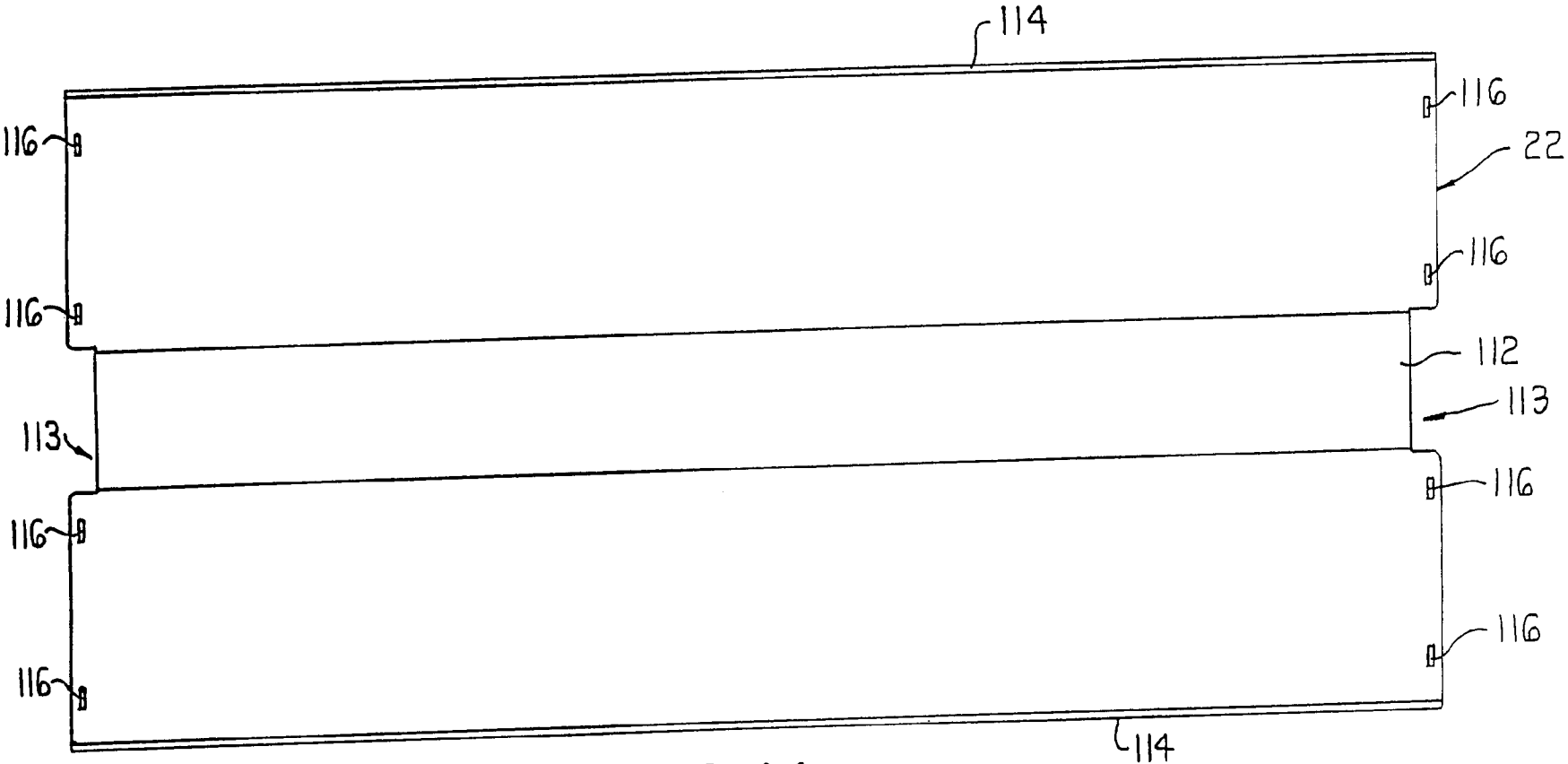
FIG. 11 is a top plan view of a bottom wall of the first cabinet drawer.

Referring to FIG. 11, the bottom wall 22 also includes four rectangular slots 116 at each opposite end 113 thereof. The slots 116 are formed at the opposite ends of the bottom wall 22 to permit the connection of the back wall 23 and the front wall 24 thereto as will be described in more detail. The bottom wall 22 therefore is formed with a symmetrical non-handed construction such that the back wall 23 and front wall 24 can be mounted to either of the opposite ends of the bottom wall 22 which simplifies the construction of the drawer 12-1.

The side walls 21 also are formed with a symmetrical non-handed construction in that the opposite ends are formed substantially the same such that the back wall 23 and front wall 24 can be mounted to either of the opposite ends. Each side wall 21 therefore is usable as either a left side wall or a right side wall.

Figure 9:
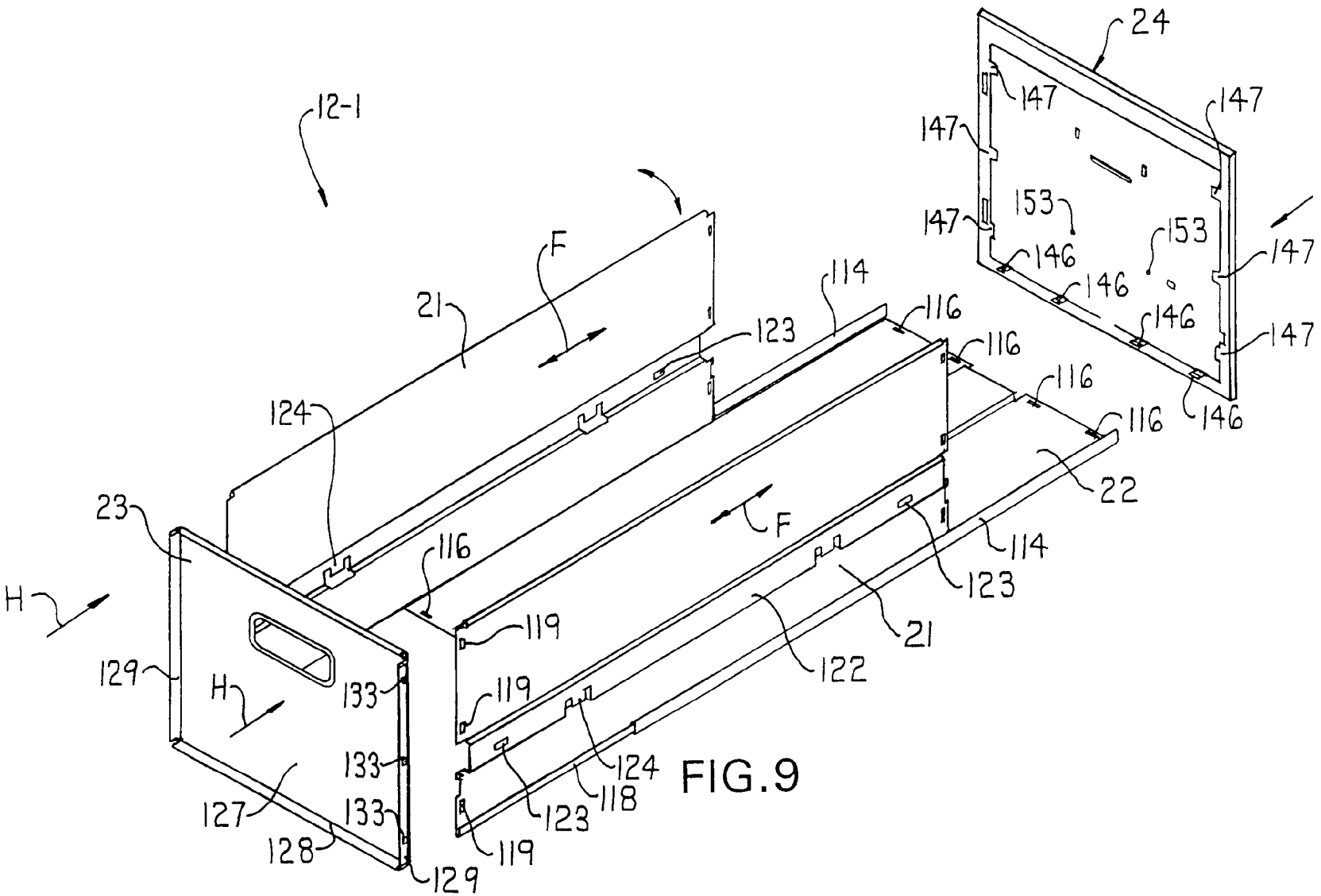
FIG. 9 is an exploded front perspective view of the first cabinet drawer of FIG. 8.
Figure 12:
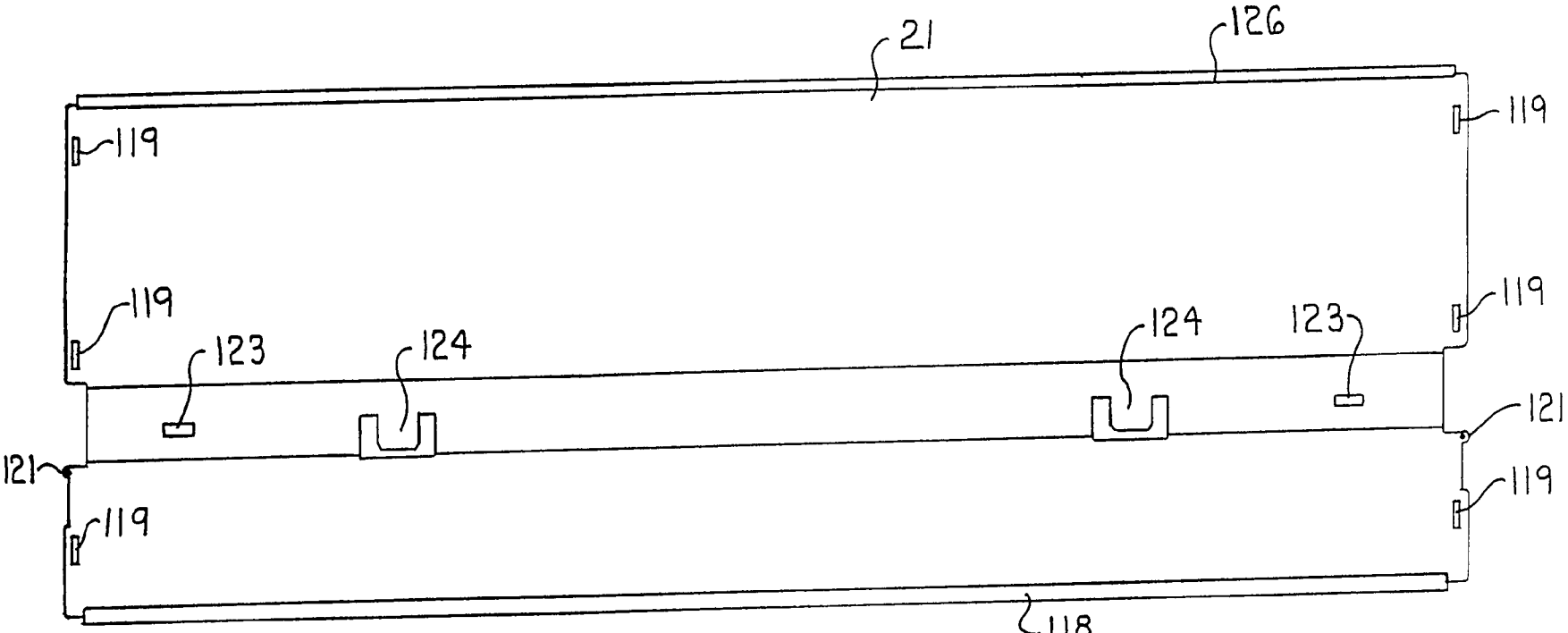
FIG. 12 is a side elevational view of a side wall of the first cabinet drawer.

Referring to FIGS. 12 and 14, each side wall 21 has a rectangular shape and is formed with a horizontally elongate bottom flange or lip 118 which projects outwardly and then upwardly from the lower edge of the side wall 21. The flange 118 has a J-shaped cross section which mates with the inverted J-shaped side channels 114 of the bottom wall 22. The interfitting J-shaped cross sections of the side wall 21 and bottom wall 22 are mated together by sliding the end of the side wall 21 in the direction of reference arrow G into one of the open ends of the side channel 114 as generally seen in FIG. 9. As a result, the spaced apart side walls 21 are slidably engaged with the opposite side edges of the bottom wall 22.

The side walls 21 also include three rectangular slots 119 which are vertically spaced apart. The slots 119 are formed substantially the same as the slots 116 on the bottom wall 22 for the connection of the back wall 23 or front wall 24 thereto. The side walls 21 further include an eyelet 121 at each opposite end which is provided for engagement with a spring (not illustrated) of the aforementioned drawer latch assembly (not illustrated). Any suitable drawer latch assembly (not illustrated) can be used and thus, a more detailed description of the latch assembly is not believed necessary.

The drawer 21 also includes an outwardly projecting strengthening channel 122 extending along the length of the side wall 22. The channel 122 is located at approximately one-third the overall height of the side wall 21.

To support the drawer 12-1, the channel 122 includes a pair of downward opening engagement pockets 123 which are adapted to be seated on a drawer slide 13 (FIG. 1) so as to mount the drawer 12-1 in the cabinet housing 11. A pair of cantilevered locking tabs 124 project outwardly and downwardly from the side wall 21 and snap lockingly engage the drawer slide 13 so as to prevent dislodgement of the drawer 12-1 therefrom. The channels 122 allow the drawer 12-1 to be laid onto the slides 13 during assembly, and then the drawer 12-1 is shifted, for example, rearwardly until the pockets 123 and tabs 124 are able to drop into locking engagement with the slides 13. Supporting a drawer by pockets 123 and tabs 124 is conventional and thus, a more detailed description of the connection of the drawer 12-1 to a drawer slide 13 is not believed necessary.

The side wall 21 also is rolled along the top edge to form a strengthening bead 126. Since the opposite ends of each side wall 21 are formed substantially identical and are engageable to both the back wall 23 and front wall 24, only one side wall construction is required. As a result, the side walls 21 are useable on either the left or right sides of the bottom wall 22.

Figure 8:
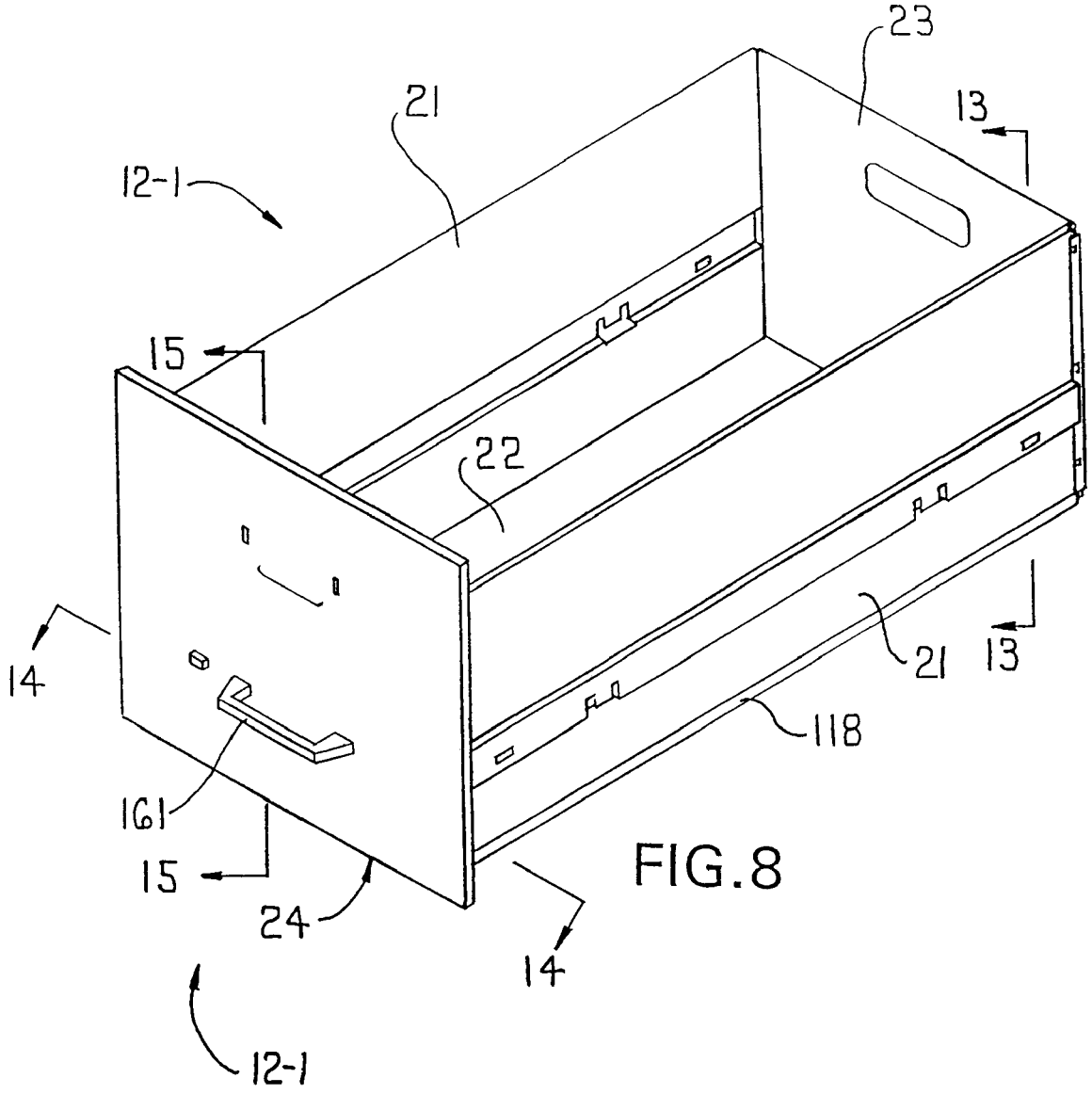
FIG. 8 is a front perspective view of a first embodiment of a knock-down cabinet drawer.
Figure 13:
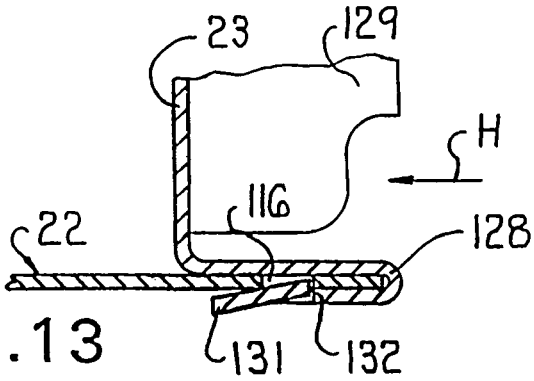
FIG. 13 is an enlarged partial side view in cross section of a connection between the back wall and the bottom wall as taken along line 13—13 of FIG. 8.

Once the left and right side walls 21 and the bottom wall 22 are slidably mated together, the back wall 23 is snap lockingly engaged to a selected end to thereby define the back of the drawer 12-1. Referring to FIGS. 8, 9 and 13, the back wall 23 has a substantially rectangular shape which encloses one end of the mated side walls 21 and bottom wall 22.

More particularly, the back wall 23 includes a central panel 127 which includes a horizontal bottom flange 128 extending laterally and a pair of laterally spaced apart vertical side flanges 129 that extend vertically along the opposite side edges thereof. The bottom flange 128 and side flanges 129 project rearwardly from the central panel 127.

With respect to the bottom flange 128, this flange 128 has a generally U-shaped cross section to define a channel which opens forwardly and slidably receives the rear edge of the bottom wall 22 therein. The bottom flange 128 also is punched when being formed so as to include four snap locking connector tabs 131 (FIG. 13) along the exterior wall of the flange 128. The tabs 131 project upwardly into the interior channel of the bottom flange 128 and are aligned laterally with the slots 116 on the back wall 22. The end of each tab 131 thereby defines a rearward facing abutment surface 132.

As seen in FIG. 13, when the bottom wall 22 is inserted into the bottom flange 128, the connector tabs 131 flex outwardly or downwardly so as to permit insertion of the bottom wall 22. When the slots 116 are aligned with the tabs 131, the tabs 131 snap lockingly engage the corresponding slots 116 so that the abutment surface 132 prevents removal of the bottom wall 22. A forward edge of the connector tab 131, however, projects downwardly from the bottom flange 128 and can be deflected to pivot the connector tab 131 out of the respective slot 116 and permit disassembly of the bottom wall 22.

The side flanges 129 are similarly formed with three side connector tabs 133 which are formed identical to the bottom connector tabs 131. The side connector tabs 133 are vertically aligned with the corresponding slots 119 on the side walls 21. The rear edges of the side walls 21 are slid into the open front side of the side flanges 129 until the side connector tabs 133 snap lockingly engage the corresponding slots 119 the same as the tabs 131 (FIG. 13). In this manner, the back wall 23 is pressed forwardly in the direction H to engage the bottom flange 128 and side flanges 129 thereof with the corresponding rear edges of the bottom wall 22 and the side walls 21.

Figure 10:
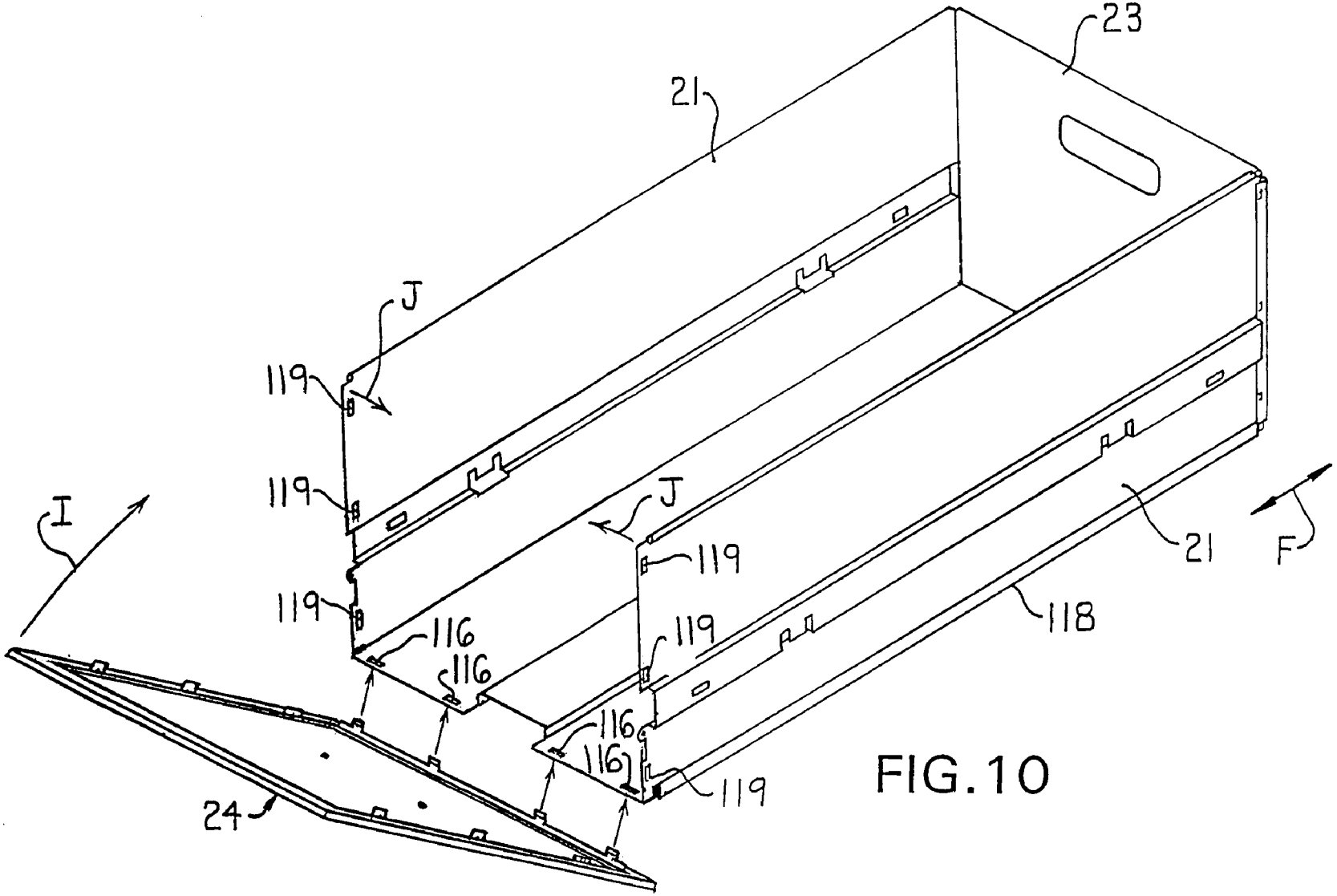
FIG. 10 is a front perspective view of the first cabinet drawer with an outer panel of the front wall illustrated in an exploded position.

The front wall 24 (FIG. 10) also is readily connectable to the front edges of the side walls 21 and bottom wall 22. Generally, the front wall 24 is formed of an outer panel 138 and an inner panel 139 (FIGS. 14–17). As seen in FIG. 10, a lower edge of the outer panel 138 first is inserted from below into the slots 116 of the bottom wall 22 and then is pivoted upwardly in the direction of reference arrow I into engagement with the side walls 21. Then, the inner panel 139 is joined thereto in face-to-face engagement to rigidly secure the outer panel 138 in position.

Figure 15:
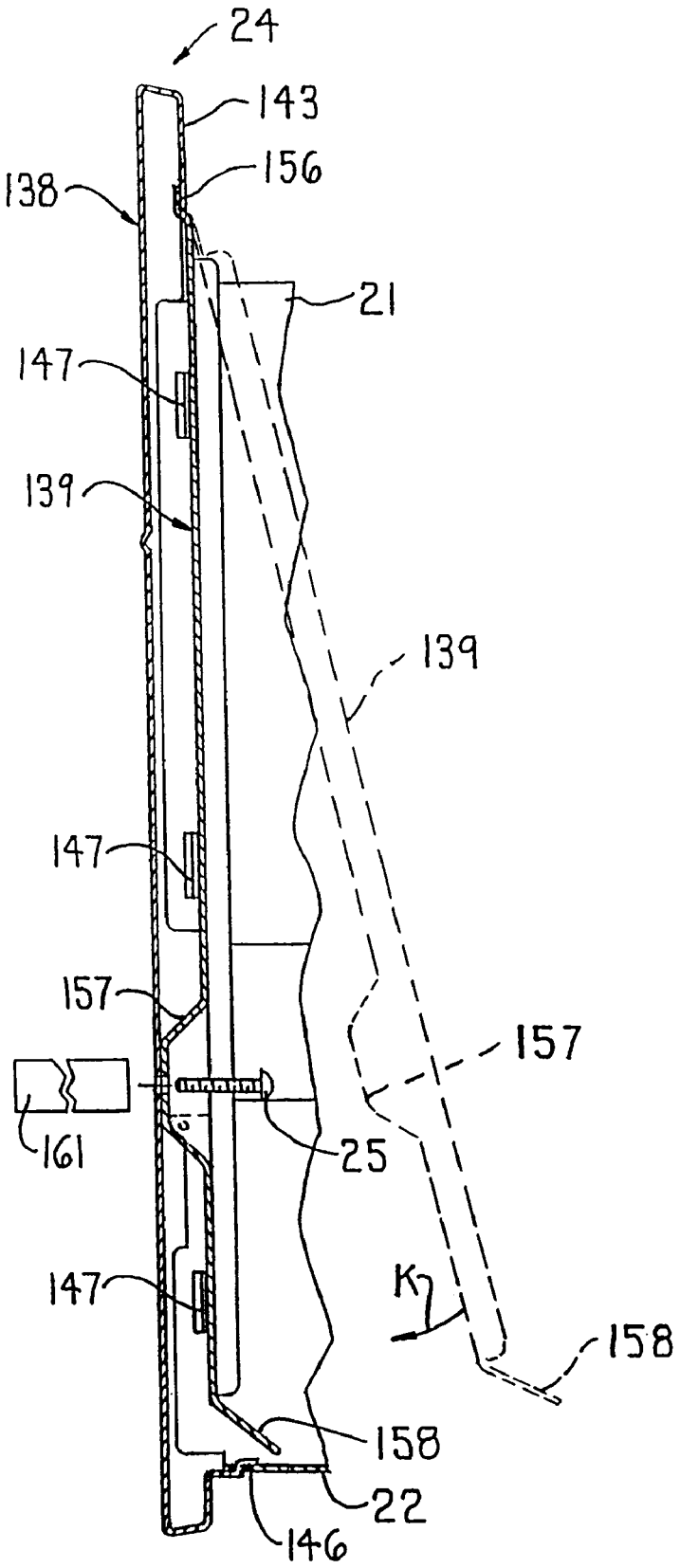
FIG. 15 is a partial side elevational view in cross section of the front wall as taken along line 15—15 of FIG. 8.
Figure 17:
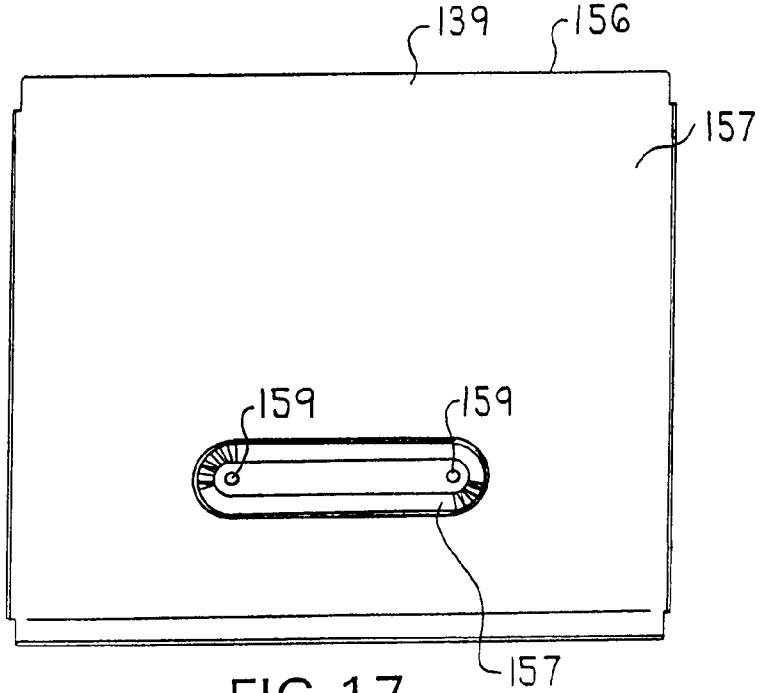
FIG. 17 is a rear elevational view of an inner panel of the front wall.
Figure 16:
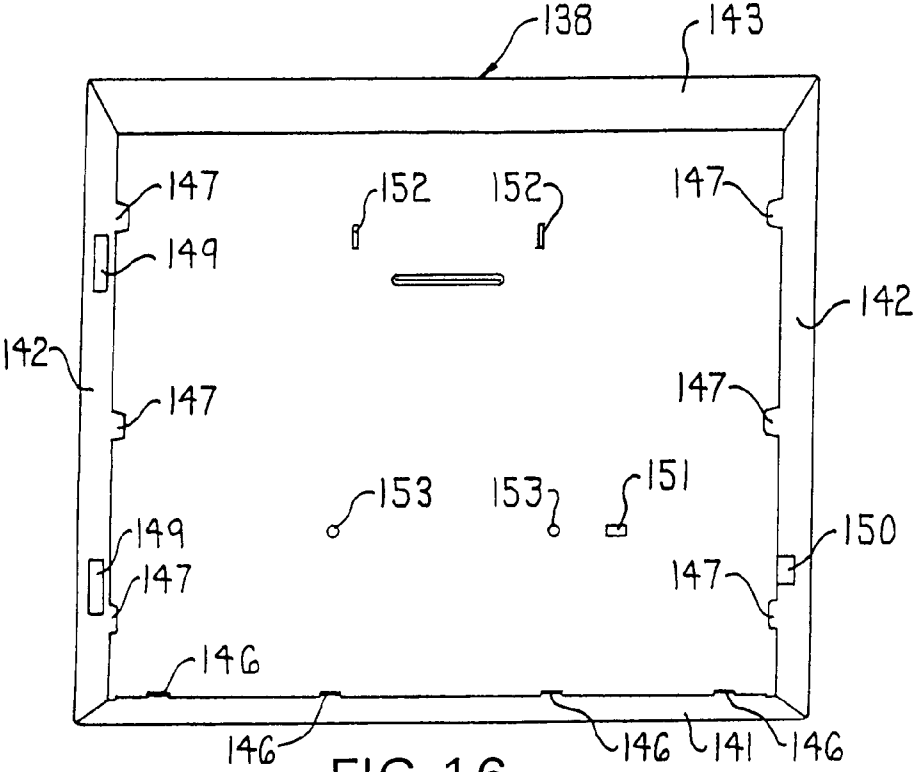
FIG. 16 is a rear elevational view of the outer panel of the front wall.

More specifically, referring to FIGS. 15 and 16, the outer panel 138 has a substantially rectangular shape which overlies the open front end of the interconnected side and bottom walls 21 and 22. The outer panel 138 includes a horizontal bottom flange 141, laterally spaced apart vertical side flanges 142 and a horizontal top flange 143 which define the rectangular peripheral edge thereof.

The bottom flange 141 includes four laterally spaced apart connector tabs 146 which project rearwardly therefrom and have a substantially Z-shaped or stepped cross section as seen in FIG. 15. This Z-shaped cross section permits the connector tabs 146 to be inserted from below into the slots 116 of the bottom wall 22 as generally seen in FIG. 10 and also permits pivoting of the upper edge of this outer panel 138 rearwardly into engagement with the side walls 21 as generally indicated by arrow I. Insertion of the bottom connector tabs 146 into the corresponding slots 116 of the bottom wall 22 thereby defines a horizontal pivot axis for the outer panel 138.

The side flanges 142 include three inwardly extending tabs 147 which are vertically spaced apart so as to align with the corresponding slots 119 on the respective side walls 21. Once the bottom connector tabs 146 are inserted into the slots 116, the upper front corners of the side walls 21 are pivoted inwardly as indicated by reference arrows J and the outer panel 138 is pivoted rearwardly (reference arrow I) into the vertical position illustrated in FIG. 15. At such time, the side walls 21 are returned to the vertical position (FIG. 14) such that the side connector tabs 147 of the outer panel 138 are slidably received through the corresponding slots 119 of the side walls 21. The outer panel 138 thereby is mounted in position.

To mount cabinet hardware to the outer panel 138, the outer panel 138 also includes a pair of vertically elongate slots 149 (FIG. 16) formed through the rear surface of one side flange 142 which are adapted to engage a locking assembly (not illustrated) for the cabinet 11. The opposite side flange 142 also includes a notch 150 which for a thumb latch assembly (not illustrated) of any suitable construction. A further aperture 151 is formed through the front surface thereof to accommodate the thumb latch (not illustrated). Additional slots 152 are formed for the connection of a name plate holder.

Further, the outer panel 138 includes a pair of apertures 153 which are laterally spaced apart and accommodate the fasteners 25 as discussed in more detail hereinafter.

The inner panel 139 (FIGS. 14, 15 and 17) is mounted on the interior side of the outer panel 138. The inner panel 139 has a substantially rectangular shape and is formed with a stepped upper edge 156, a central indented section 157 and a rearwardly extending lower flange 158 along the horizontal bottom edge thereof. More particularly, the stepped upper edge 156 is inserted or slipped under the top flange 143 of the outer panel 138 which thereby defines a horizontal pivot axis for the inner panel 139. The inner panel 139 is then pivoted downwardly and forwardly as generally illustrated by reference arrow K (FIG. 15) to a substantially vertical position. In this vertical position, the indented section 157 abuts against the interior surface of the outer panel 138. Further, the opposite side edges of the inner panel 139 are disposed closely adjacent the connector tabs 147 of the side flanges 142 of the outer panel 138.

To secure the inner panel 139 to the outer panel 138 in face-to-face engagement, the indented section 157 includes a pair of apertures 159 which are coaxially aligned with the apertures 153 on the outer panel 138 so as to receive the fasteners 25 therethrough. A U-shaped handle 161 is positioned on the front side of the outer panel 138 and includes rearwardly opening bores which are coaxially aligned with the apertures 153 and 159. The fasteners 25 are inserted forwardly through the apertures 153 and 159 and screwed into the bores of the handle 161 so as to effectively secure the inner panel 139 to the outer panel 138.

When the inner panel 139 is secured in this vertical position, the vertical side edges thereof abut against the side walls 21 (FIG. 14) and prevent the side walls 21 from being flexed inwardly in the direction of arrows J as is required for removal of the outer panel 138. Thus, both the inner panel 139 and outer panel 138 are fixedly secured in position and cannot be removed without removal of the fasteners 25 and handle 161.

Further, the bottom flange 158 on the inner panel 138 angles rearwardly a small distance so as to overlie the bottom connector tabs 146 on the outer panel 138 to enclose and protect these tabs 146.

As can be seen, all of the separate component parts, namely the left and right side walls 21, bottom wall 22, back wall 23, front wall 24 and fasteners 25 can be shipped in the knocked-down condition in combination with the components of the cabinet housing 11 described above.

Thereafter, the drawer components are assembled by sliding the flanges 118 of the side walls 21 into the corresponding edge channels 114 on the bottom wall 22 (arrows F) and then the back wall 23 is snapped onto the rear edges thereof (arrow H). To mount the front wall 24 in place, the upper front corners of the side walls 21 are flexed inwardly (arrows J) and the connector tabs 146 of the outer panel 138 are inserted from below into the corresponding slots 116 on the bottom wall 22. Thereafter, the outer panel 138 is pivoted upwardly and rearwardly (arrow I) until the side connector tabs 147 are aligned with the corresponding slots 119 on the side walls 21. The side walls 21 are then deflected back to the vertical position such that the tabs 147 are engaged with the slots 119. Next, the stepped upper edge 156 of the inner panel 139 is secured under the top flange 143 of the outer panel 138 and the inner panel 139 is pivoted downwardly and forwardly (arrow K) into opposed relation with the outer panel 138. The fasteners 25 are inserted through the coaxially aligned apertures 153 and 159 and threadingly engaged with the handle 161 to prevent disassembly of the component parts.

With respect to the second embodiment of the knock-down cabinet drawer 12-2 (generally seen in FIG. 22), the bottom wall 30, left and right side walls 31 and back wall 32 thereof are formed from a single planar sheet of a sheet metal material while the front wall 34 (FIG. 18) is a separate removable component. This allows for the walls to be shipped as a single flat sheet which can then be folded up along the side and back fold lines 29 into the three-sided box-like configuration illustrated in FIG. 19. Thereafter, the separate front wall 34 is attached thereto to form the cabinet drawer 12-2.

Referring more particularly to FIGS. 20–23, the sheet of material 28 is formed with a central rectangular portion which defines the rectangular bottom wall 30. The bottom wall 30 further includes an upstanding U-shaped front flange 211 along the horizontal front edge thereof which opens downwardly for the connection of the front wall 34 as will be described in more detail hereinafter.

The sheet of material 28 also includes rows of side perforations 212 which extend linearly along the opposite sides of the bottom wall 30. The perforations 212 thereby define the perforated fold lines 29-1 and are separated one from the other by connector webs 213 which join the side walls 31 to the opposite sides of the bottom wall 30. The side perforations 212 and webs 213 allow the side walls 31 to be folded upwardly about the respective fold lines 29-1 so as to be foldable from the horizontal flat position of FIG. 20 to the vertically upstanding position of FIG. 19 as will be discussed in more detail herein with respect to the side walls 31.

The sheet 28 also includes a row of elongate perforations 214 which extend laterally to define a back fold line 29-2. The back wall 32 is joined to the bottom wall 30 along this laterally extending fold line 29-2 by webs 215. The back wall 32 thereby is foldable upwardly from the flat position illustrated in FIG. 20 to the vertically upstanding position illustrated in FIG. 19. These perforations 212 and 214 thereby permit the sheet 28 to be shipped in the flat condition of FIG. 20.

More particularly with respect to the back wall 32 and side walls 31, the back wall 32 is substantially rectangular and includes connector flanges 216 along the opposite side edges thereof. These flanges 216 are bent at a right angle so as to project rearwardly from the back wall 32 (FIG. 21) when in the upright position.

Figure 21:
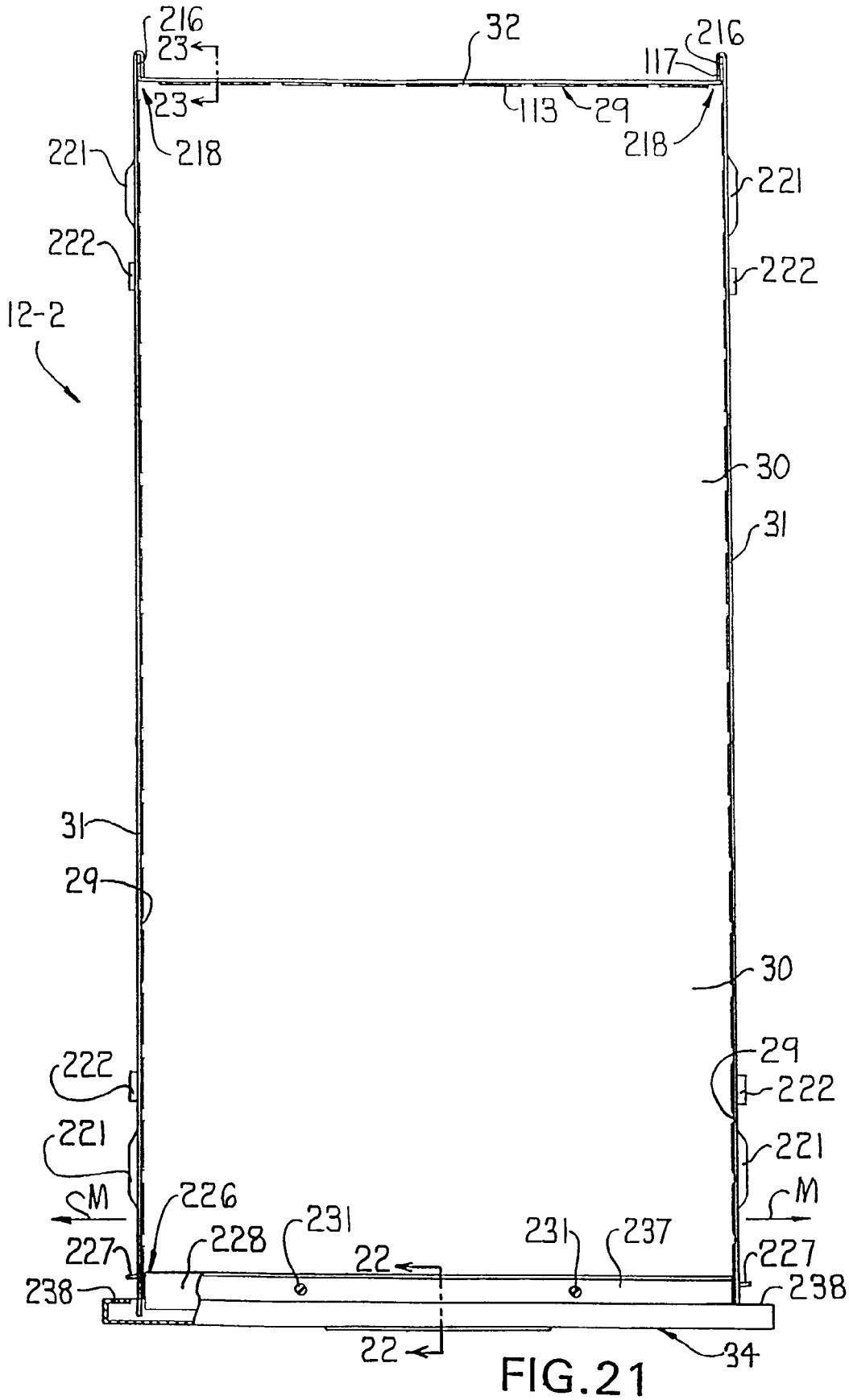
FIG. 21 is a top plan view of the cabinet drawer of FIG. 18.
Figure 23:
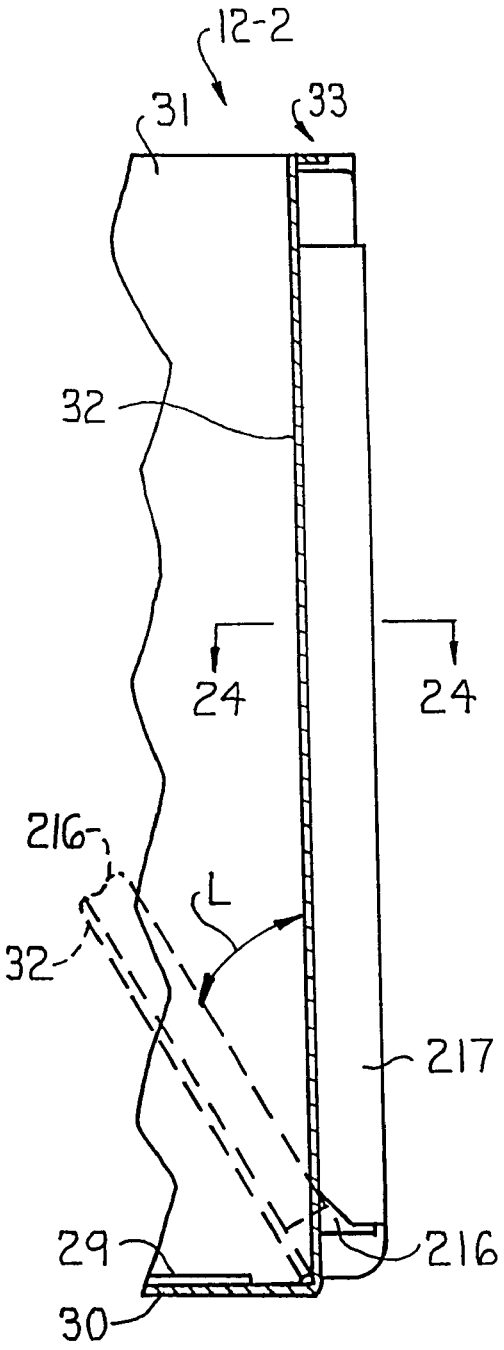
FIG. 23 is a partial cross-sectional side view in cross section of a rear wall of the cabinet drawer as taken along line 23—23 of FIG. 21.
Figure 24:
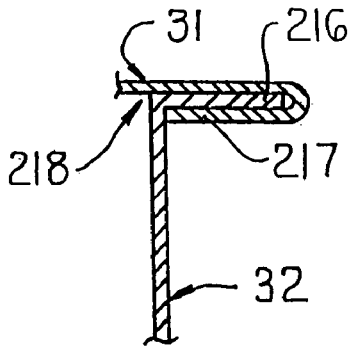
FIG. 24 is a top cross-sectional view of a corner connection as taken along line 24—24 of FIG. 23.

To connect the side walls 31 and the back wall 32 together when folded upwardly, each side wall 31 includes a corner flange 217 which is formed in a U-shape on the interior side of the side wall 31. Referring to FIGS. 21, 23 and 24, each corner flange 217 defines an elongate slot 218 along the back edge of the side wall 31. When the side wall 31 is folded upwardly, the corner slot 218 opens forwardly to tight-fittingly receive a respective one of the corner flanges 216 of the back wall 32.

As seen in FIG. 23, the back wall 32 is secured to the side walls 31 by pivoting the back wall 32 about the back fold line 29-2 until the side flanges 216 are moved forwardly past the slots 218 of the side walls 31 (as seen in phantom outline). Thereafter, the side walls 31 are moved inwardly against the back wall 32, and the back wall 32 is moved backwards as generally indicated by reference arrow L until the vertical flanges 216 are slid rearwardly into the slots 218 as seen in FIG. 24. The flanges 216 are received in tight fitting engagement in the slots 218 so as to interlock the back wall 32 with the side walls 31 and define the rear corners 33 of the drawer 32.

To support the cabinet drawer 12-2 in the housing 11, the side walls 31 also include engagement pockets 221 (FIGS. 18, 19 and 23) near the bottom edge thereof. The pockets 221 project outwardly and open downwardly similar to the pockets 123 of the drawer 12-1. The pockets 221 are adapted to receive an upwardly extending tab (not illustrated) of the drawer slide 13. The side walls 31 also include cantilevered lock tabs 222 which project upwardly and outwardly from the side walls 31. The lock tabs 222, similar to tabs 124, lockingly engage the drawer slide 13 such that a pair of drawer slides 13 support the drawer 12-2 within the above-described cabinet housing 11.

While side walls 31 are planar and the pockets 221 and tabs 222 are readily engagable with conventional drawer slides, the side walls 31 preferably are formed with a raised channel like the channel 122 and the pockets 221 and tabs 222 are formed therein.

To mount the front wall 34 to the side walls 31, each side wall 31 also includes a pair of elongate locking slots 223 (FIG. 20) near the front edge thereof. When the side walls 31 are oriented vertically, the slots 223 are located near the upper front corner of the side walls 31.

Figure 19:
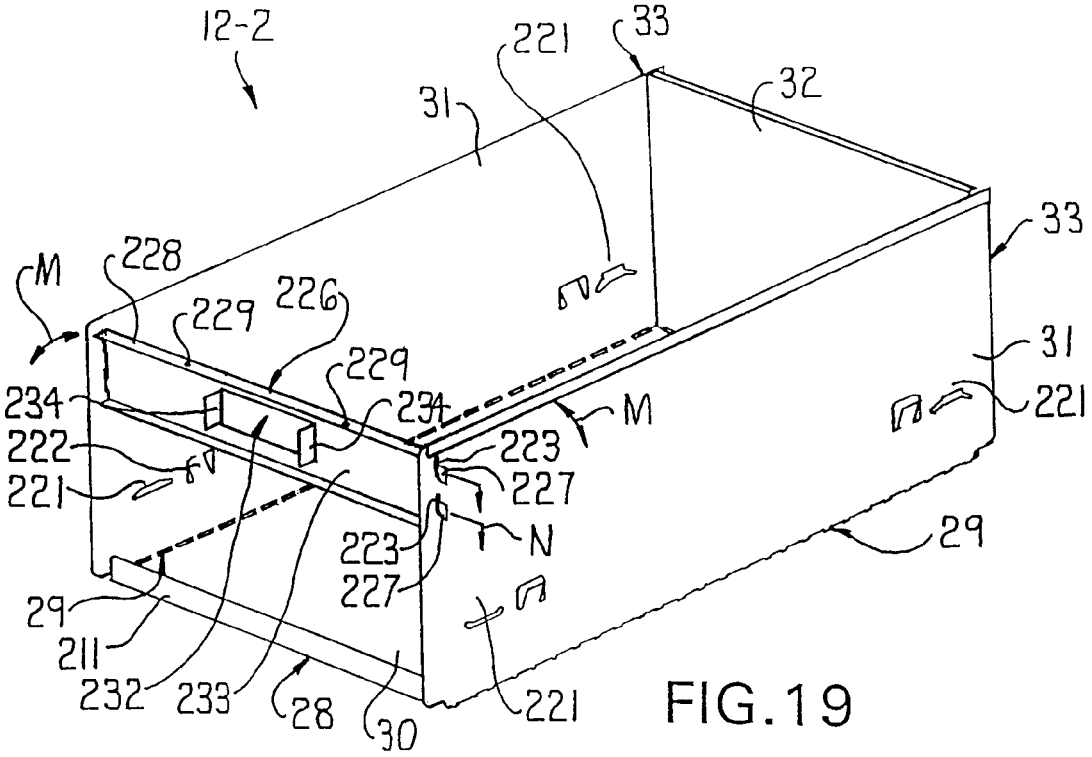
FIG. 19 is a front perspective view of the second cabinet drawer of FIG. 18 with a front wall removed.
Figure 25:
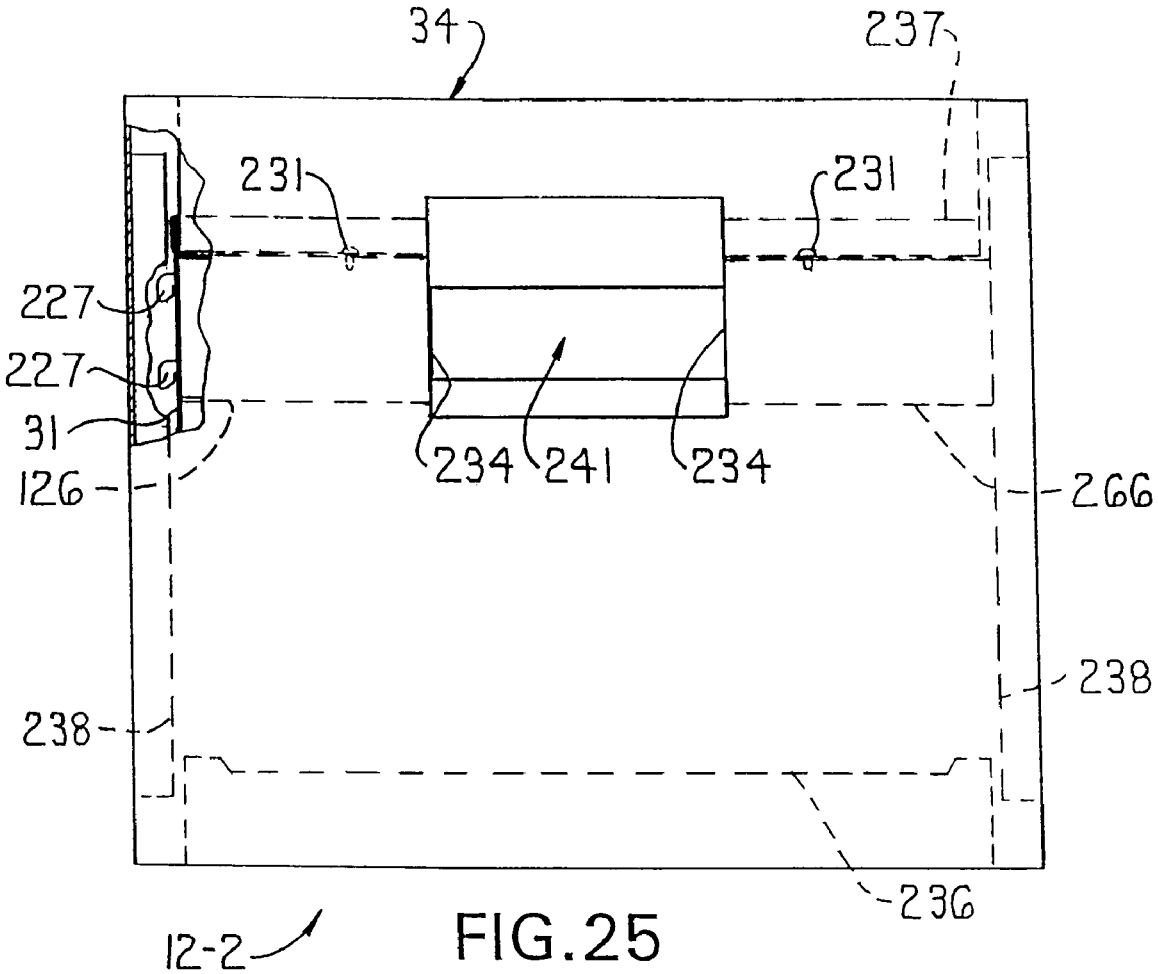
FIG. 25 is a front elevational view in partial cross section of the drawer of FIG. 18.
Figure 26:
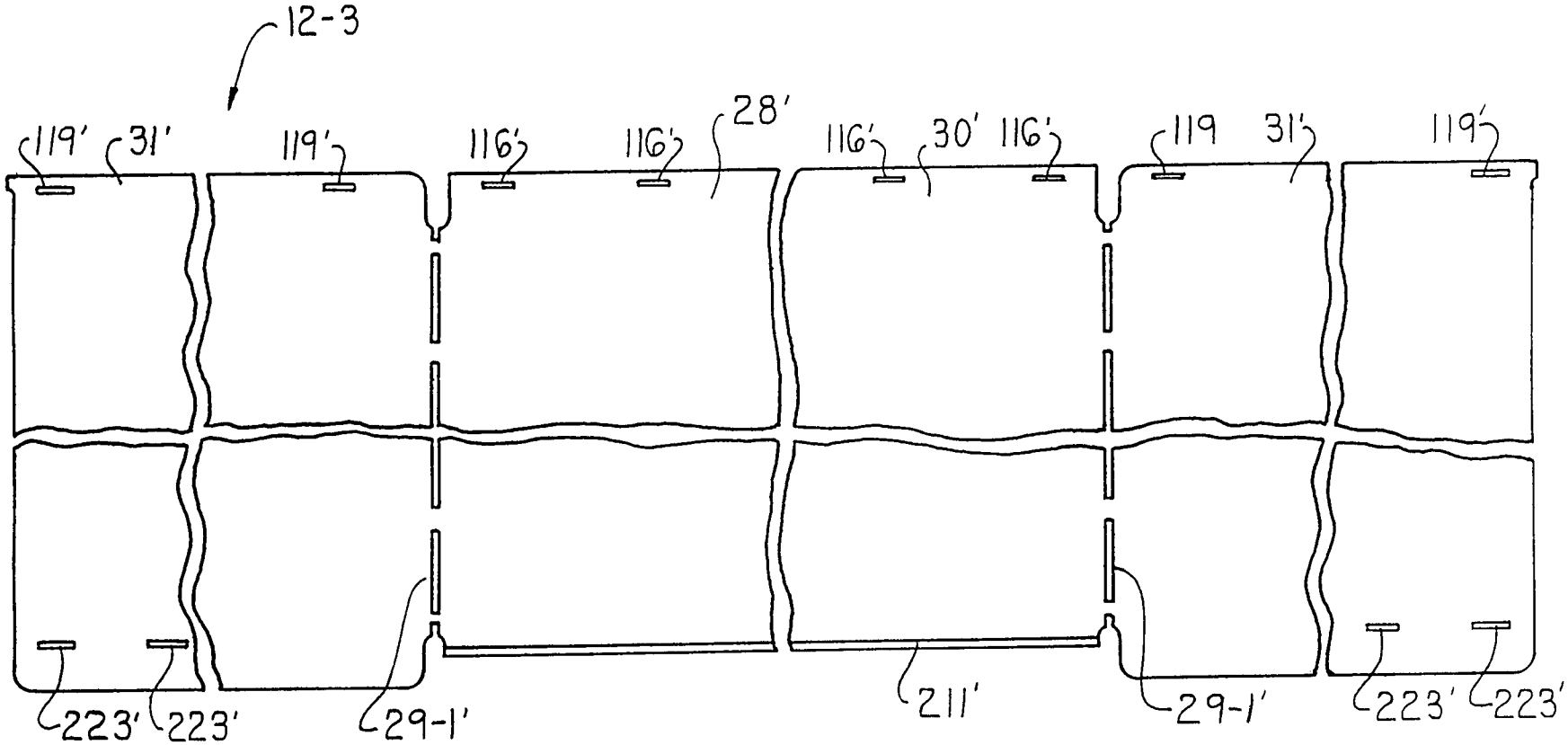
FIG. 26 is a broken top plan view of a drawer cutout for a third embodiment of the knock-down cabinet drawer.

To secure the front edges of the side walls 31 together, the drawer 12-2 also includes a horizontal locking bar 226 as illustrated in FIGS. 19, 21 and 25. Generally, the opposite ends of the locking bar 226 are connected to the upper front corners of the side walls 31 so as to rigidly secure the side walls 31 together and also provide a mounting location for the front wall 34.

Figure 22:
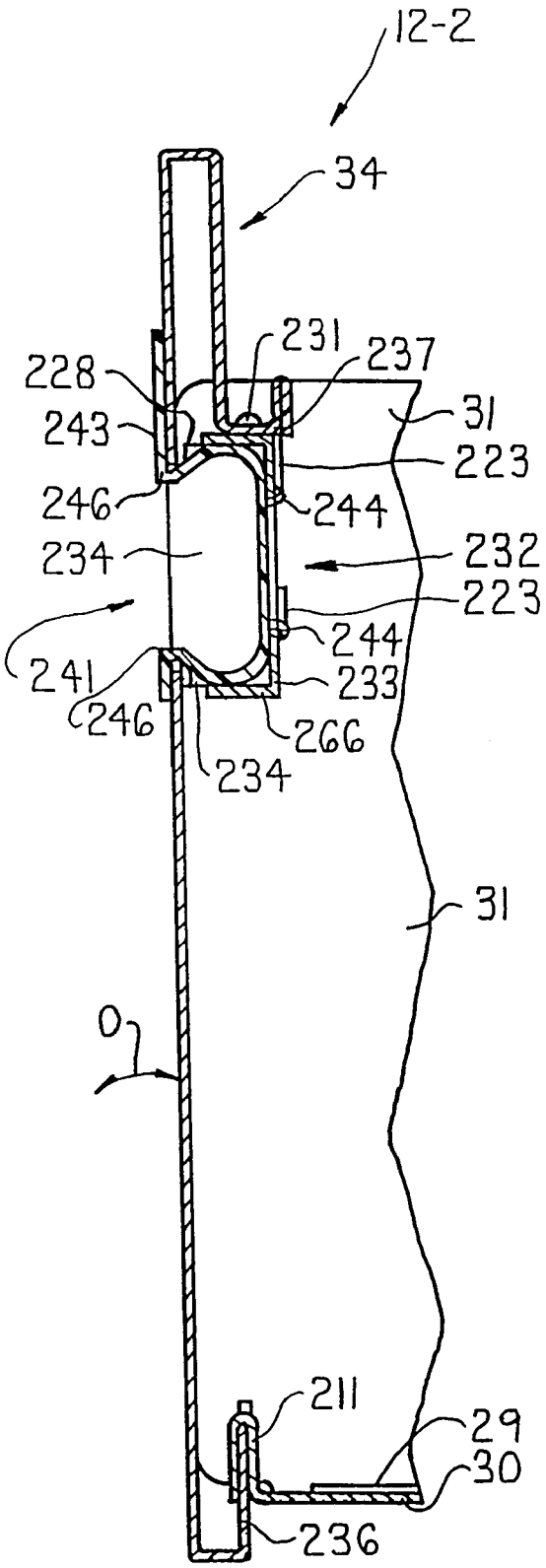
FIG. 22 is a partial cross sectional side view of the front wall of the second cabinet drawer as taken along line 22—22 of FIG. 21.

More particularly, the locking bar 226 has a C-shaped cross section which opens forwardly, and includes a pair of sidewardly projecting hooks 227 at each opposite end thereof as seen in FIGS. 19 and 22.

The hooked projections 227 project sidewardly and downwardly, and are vertically spaced apart one from the other so as to be received through the vertically spaced locking slots 223 provided on the side walls 31.

To assemble the locking bar 226 to the slots 223, the upper front corners of the side walls 31 are flexed outwardly a small distance as indicated by reference arrows M (FIG. 19) which allows the locking bar 226 to be moved into the open area between the side walls 31. Thereafter, the upper corners of the side walls 31 are pivoted back to the upright vertical position so that the hooks 227 are inserted through the corresponding slots 223. Thereafter, the locking bar 226 is shifted downwardly (as generally indicated by arrows N) so that the hooks 227 positively engage the side walls 31 and prevent both outward and inward deflection thereof.

The locking bar 226 includes an upper horizontal edge 228 (FIG. 19) which is formed with a pair of laterally spaced apart apertures 229 opening vertically therethrough. These apertures 229 engage fasteners 231 for the connection of the front wall 34 as will be described in more detail hereinafter.

To provide a hand grip for opening the drawer 12-2, the locking bar 226 includes a rectangular opening 232 which is formed centrally through the back 233 thereof. The opposite side edges of the opening 232 preferably include a pair of bent plates 234 which extend forwardly from the back 233.

After the locking bar 226 is engaged to the side walls 31, the front wall 34 is mounted thereto. Generally, the front wall 34 has a rectangular shape which encloses the open front of the drawer 12-2. The front wall 34 is dimensioned so as to extend sidewardly past the side walls 31 and upwardly above the upper edges of the side walls 31 so as to fully enclose the opening 18 formed in the cabinet housing 11 (FIG. 1).

Preferably, the front wall 34 is formed of a single continuous sheet of sheet metal which is formed into a box-like shape which opens rearwardly so as to receive the side walls 31 therein. More particularly, the front wall 34 includes a horizontal bottom flange 236 (FIGS. 21, 22, 25) which extends upwardly, and a horizontal top flange 237 which is positioned close to the upper edge of the side walls 31 when the front wall 34 is mounted in position.

The front wall 34 also includes opposite side flanges 238 which extend inwardly but are spaced a slight distance from the ends of the bottom and top flanges 236 and 237 as seen in FIG. 25 so as to define a gap therebetween. This gap permits the front vertical edges of the side walls 31 to be inserted therebetween as seen in FIG. 21 such that the front wall 34 essentially is fitted over the front edges of the side walls 31.

To mount the front wall 34 in position, the bottom flange 236 fits into the downward opening flange 211 of the bottom wall 30 as seen in FIG. 22. Since the flanges 211 and 236 are formed of sheet metal, some flexing of the flanges 211 and 236 is permitted such that the flange 236 can be inserted upwardly into the front flange 211 while the front wall 34 is flexed forwardly a small distance from the vertical upright position. The top flange 237 of the front wall 34 is thereafter pivoted rearwardly over the top of the locking bar 226 as indicated generally by reference arrow O.

The top flange 237 also includes a pair of laterally spaced apertures which line up with the apertures 229 of the locking bar 226 when the front wall 34 is mounted in place so as to permit engagement of the fasteners 231. The fasteners 231 thereby fasten the top flange 237 of the front wall 34 to the locking bar 226. As a result, the front wall 34 is secured at the top to the locking bar 226 and at the bottom to the front flange 211 of the bottom wall 30.

Figure 18:
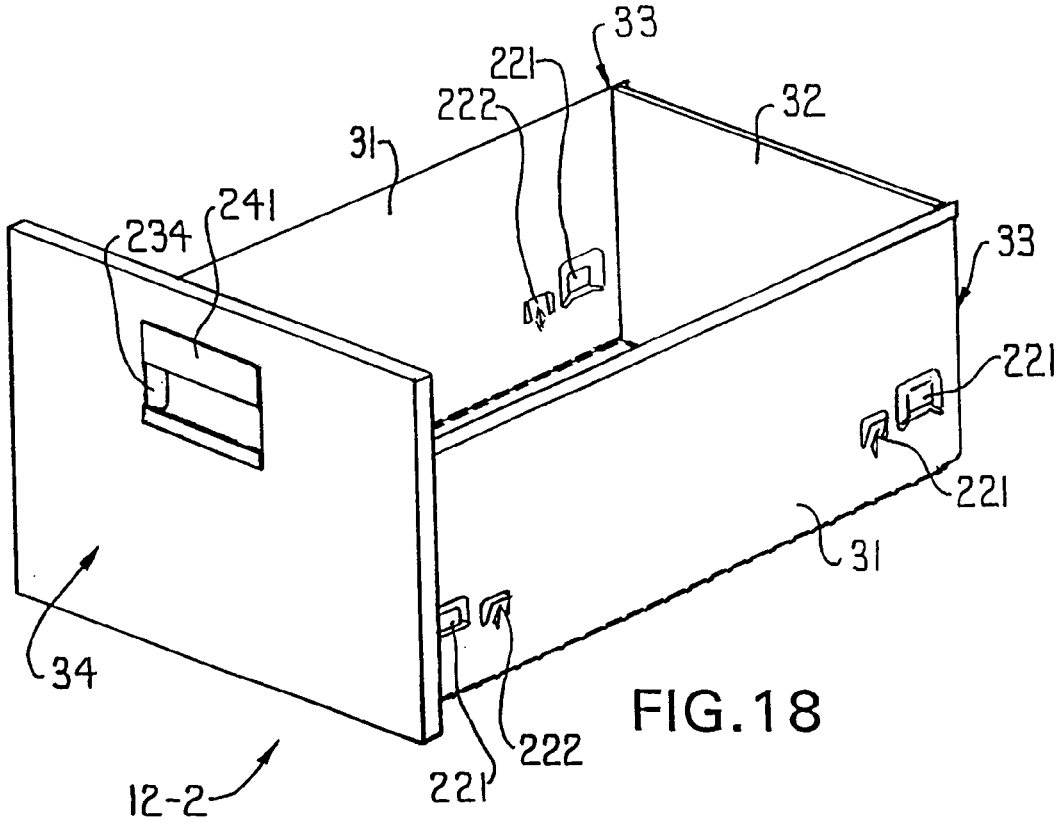
FIG. 18 is a front perspective view of a second embodiment of the knock-down cabinet drawer.
Figure 20:
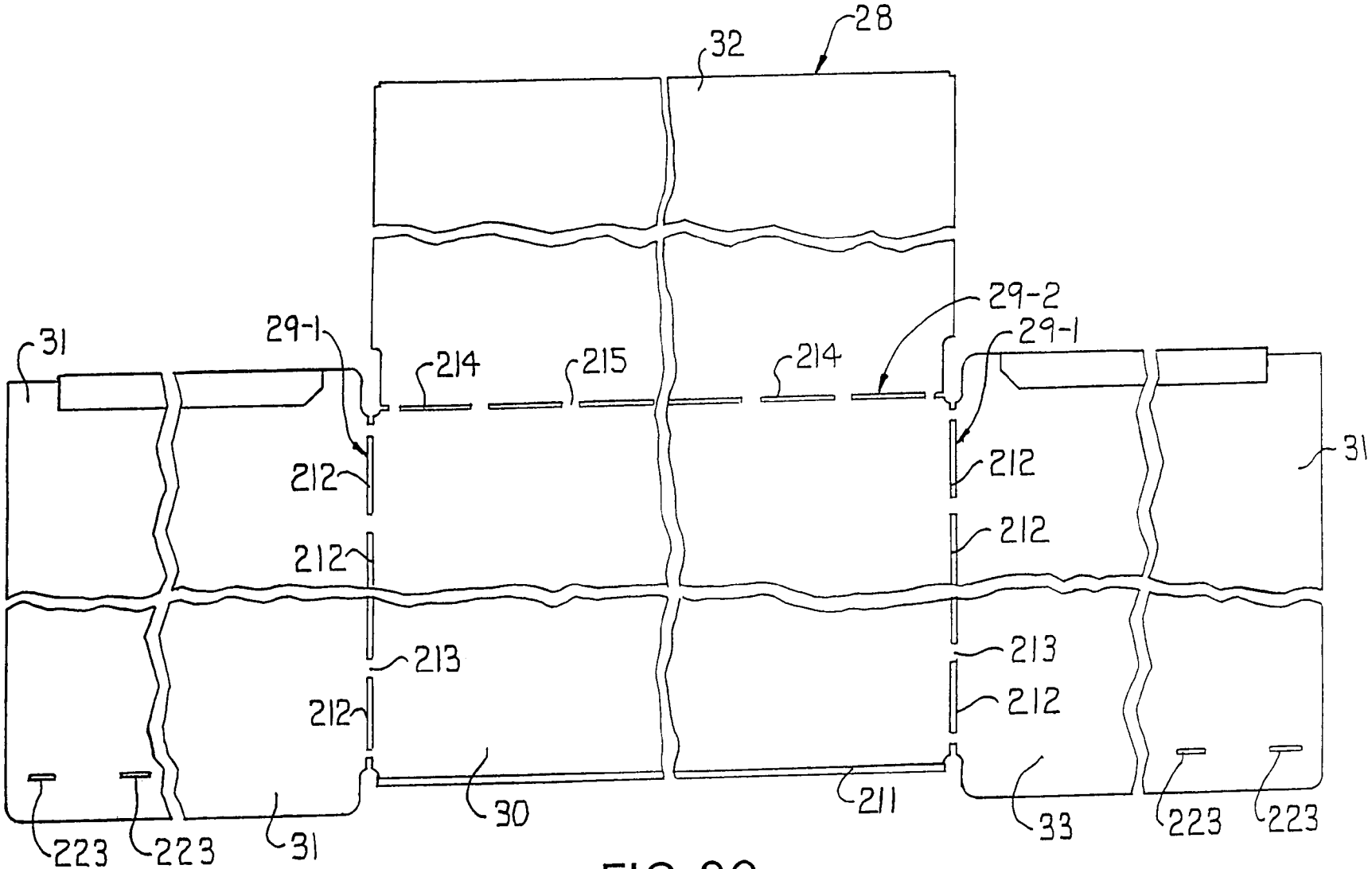
FIG. 20 is a broken top plan view of a drawer cut-out from which the bottom, side and back walls of the drawer of FIG. 19 are formed.

Referring to FIGS. 18 and 21, the front wall 34 also includes a rectangular opening 241 which is disposed in registry with the opening 232 of the locking bar 226.

The front wall 34 further includes a hand pull insert 243 which snaps into the aligned openings 241 and 232. The insert 243 preferably is formed of plastic and has a forward-opening generally U-shape. The insert 243 fits through the opening 241 of the front wall 34 and includes a pair of snap locking horizontal ribs 244 which snap lockingly engage the edges of the opening 232 formed in the locking bar 226. When the insert 243 is fitted through the opening 241, forward edges 246 of the insert 243 also engage the upper and lower edges of the front wall opening 241 so as to securely engage the front wall 34. The insert 243 thereby defines a hand grip for the drawer 12-2 to facilitate opening and closing thereof. Also, flanges 234 close off the ends of insert 243 to complete the hand pull.

As can be seen, the second embodiment of the drawer 12-2 is formed of separable components, namely the sheet 28 that defines the bottom wall 30, side walls 31 and back wall 32, the locking bar 226, the front wall 34 and the hand pull insert 243 which all can be shipped together in a relatively compact container.

To assemble the drawer 12-2, the side walls 31 are folded upwardly and then the back wall 32 is folded forwardly past the flanges 217 thereof (arrow L). Thereafter, the back wall 32 is folded rearwardly back to the vertical position so that the side flanges 216 thereof seat within the slots 218 such that the side walls 31 and the back wall 32 are rigidly joined together at the rear corners 33. The upper front corners of the side wall 31 thereafter are flexed outwardly (arrow M) to permit the locking bar 226 to be positioned therebetween as seen in FIG. 19. The lower flange 236 of the front wall 34 is then seated within the front flange 211 of the bottom wall 30 with the front wall 34 in a forwardly inclined orientation, and thereafter the front wall 34 is pivoted rearwardly (arrow O) until the top flange 237 thereof is fitted over the top of the locking bar 226. Fasteners 231 are driven downwardly through the front wall 34 and the locking bar 226. Lastly, the insert 243 is snapped rearwardly through the opening 241 into secured engagement with both the opening 241 of the front wall 34 as well as the opening 232 of the locking bar 226. The fully assembled drawer 12-2 can then be mounted to drawer slides 13 in a conventional manner.

In a preferred drawer 12-3 (FIG. 26) where a reduction in material is desired, it is possible to save material by eliminating the back wall 32 from the sheet of material 28. Instead, the material sheet 28' for the drawer 12-3 includes the bottom wall 30' and side walls 31' integrally joined together by fold lines 29-1'. The parts of the drawer 12-3 which correspond to parts described above with respect to the drawers 12-1 and 12-2 are identified with the same reference numerals although a prime (') has been added thereto.

In the drawer 12-3, the back wall 32 of the drawer 12-2 is not provided. Rather, the front ends of the bottom wall 30 and side walls 31 are formed the same as the drawer 12-2 to engage the above described front wall 34. The back ends of the bottom wall 30 and side walls 31, however, are adapted to snap lockingly engage the back wall 23 of the drawer 12-1. In particular, the bottom wall 30 and side walls 31 can be provided with the locking slots 116' and 119' which are formed substantially the same as those provided on the respective bottom and side walls 22 and 21 in the first drawer embodiment 12-1. Accordingly, a back wall formed substantially the same as the back wall 23 discussed above is snapped onto the side walls 31' and bottom wall 30'. Essentially, the preferred embodiment of the drawer eliminates the foldable back wall 32 of the second embodiment and replaces same with the back wall 23 of the first embodiment 12-1.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a file cabinet including a box-like enclosure having a hollow interior which is open on a front thereof, and at least one drawer received in said hollow interior, comprising the improvement wherein said drawer includes a planar rectangular sheet which defines a bottom wall in a center portion thereof and opposite side walls disposed on the opposite sides of said bottom wall, said side walls and said bottom wall being joined together by rearwardly extending foldable sections which define fold lines about which said side walls are foldable upwardly to a vertical upright position, said bottom wall including a connector section proximate a front edge thereof and each of said side walls including at least one mounting section disposed proximate a front end edge thereof, said drawer including a horizontal locking bar which extends between said mounting sections of said side walls and includes bar engagement means on opposite ends thereof for engaging said opposite ends of said locking bar respectively to said mounting sections of said side walls, said drawer further including a front wall which encloses a front end of said drawer, said front wall including wall engagement means proximate a bottom edge thereof which is engaged with said connector section of said bottom wall to engage said front wall to said bottom wall, said front wall including a projecting flange for engagement with said locking bar, said connector section and said wall engagement means when engaged together permitting rearward pivoting of said front wall to a vertical upright position wherein said projecting flange is disposed adjacent to said locking bar, said drawer including locking means for engaging said projecting flange to said locking bar to prevent dislodgement of said front wall from said bottom and side walls.

2. A cabinet drawer according to claim 1, wherein said sheet further defines a back wall, said back wall being joined to said bottom wall by a foldable section that extends sidewardly, said sidewardly extending foldable section defining a fold line about which said back wall is foldable upwardly to a vertical upright position enclosing a back end of the drawer.

3. A cabinet drawer according to claim 2, wherein said back wall includes rearwardly extending connector flanges on opposite side edges thereof and said side walls include forwardly opening channels on rear end edges thereof which are adapted to receive said connector flanges therein, said back wall being foldable both forwardly past said vertical upright position and rearwardly back to said upright position to permit insertion of said connector flanges rearwardly into said channels of said side walls.

4. A cabinet drawer according to claim 1, wherein each of said side walls includes a plurality of elongate slots which are disposed near a back edge thereof and are vertically spaced apart, said bottom wall including a plurality of elongate slots which are disposed near a back edge thereof and are sidewardly spaced apart, a back wall being provided which includes at least three elongate channels which extend along a bottom edge and opposite vertical side edges thereof, said channels opening forwardly so as to receive the respective back edges of said bottom wall and said opposite side walls therein, each of said channels including locking means engagable with said slots for connecting said back wall to said side and bottom walls.

5. A cabinet drawer according to claim 4, wherein said locking means comprise a plurality of tabs in each of said channels which project inwardly from one interior side thereof so as to each define a rearward facing abutment surface, said tabs being aligned with said respective slots in said side and back walls such that said rearward facing abutment surface snaps into said slots upon insertion of the back edges of said side walls and said back wall into said corresponding channels.

6. A cabinet drawer according to claim 1, wherein said connector section of said bottom wall comprises a downward opening channel, and said wall engagement means comprises an upwardly extending projection which is insertable from below into said channel to engage said front wall to said bottom wall, said mounting section of each of said side walls including at least one aperture and said bar engagement means comprising L-shaped tabs on said opposite ends of said locking bar which project outwardly and vertically so, as to be slidable sidewardly into said respective apertures on said side walls and engage said side walls to said locking bar by vertical shifting of said locking bar relative to said side walls.

7. A cabinet drawer according to claim 6, wherein said locking bar is shiftable in a first direction to engage said tabs with said apertures of said side walls, said projecting flange of said front wall being disposed closely adjacent a side of said locking bar facing in a second direction opposite said first direction to prevent vertical shifting of said locking bar in said second direction, said locking means engaging said projecting flange to said locking bar so as to prevent forward shifting of said front wall from said vertical upright position.

8. In a file cabinet including a hollow interior which is open on a side thereof, and at least one drawer received in said hollow interior, comprising the improvement wherein said drawer includes a planar rectangular sheet which defines a bottom wall in a center portion thereof and side walls disposed on the opposite sides of said bottom wall, said side walls and said bottom wall being joined together by rearwardly extending foldable sections which define fold lines about which said side walls are foldable upwardly to an upright position, said bottom wall including a connector section proximate a front edge thereof and each of said side walls including at least one mounting section disposed proximate an upper front corner thereof, said drawer including a horizontal locking bar which extends between said mounting sections of said side walls and includes hooks on opposite ends thereof which removably engage said opposite ends of said locking bar with said mounting sections of said side walls, said drawer further including a front wall which encloses a front end of said drawer, said front wall including a wall connector proximate a bottom edge thereof which engages said connector section of said bottom wall when said front wall is in an inclined position, said front wall further including a projecting flange for engagement with said locking bar, said connector section and said wall connector when engaged together permitting rearward pivoting of said front wall from said inclined position to a vertical upright position wherein said projecting flange is disposed adjacent to said locking bar, said drawer including fasteners which engage said projecting flange to said locking bar to prevent dislodgement of said front wall from said bottom and side walls.

9. A cabinet drawer according to claim 8, wherein said sheet further defines a back wall, said back wall being joined to said bottom wall by a foldable section that extends sidewardly, said sidewardly extending foldable section defining a fold line about which said back wall is foldable upwardly to a vertical upright position enclosing a back end of the drawer.

10. A cabinet drawer according to claim 9, wherein said back wall includes rearwardly extending connector flanges on opposite side edges thereof and said side walls include forwardly opening channels on rear end edges thereof which are adapted to receive said connector flanges therein, said back wall being foldable both forwardly past said vertical upright position and rearwardly back to said upright position to permit insertion of said connector flanges rearwardly into said channels of said side walls.

11. A cabinet drawer according to claim 8, wherein each of said side walls includes a plurality of elongate slots which are disposed near a back edge thereof and are vertically spaced apart, said bottom wall including a plurality of elongate slots which are disposed near a back edge thereof and are sidewardly spaced apart, a back wall being provided which includes at least three elongate channels which extend along a bottom edge and opposite vertical side edges thereof, said channels opening forwardly so as to receive the respective back edges of said bottom wall and said opposite side walls therein, each of said channels including locking parts engagable with said slots which connect said back wall to said side and bottom walls.

12. A cabinet drawer according to claim 11, wherein said locking parts comprise a plurality of tabs in each of said channels which project inwardly from one interior side thereof so as to each define a rearward facing abutment surface, said tabs being aligned with said respective slots in said side and back walls such that said rearward facing abutment surface snaps into said slots upon insertion of the back edges of said side walls and said back wall into said corresponding channels.

13. A cabinet drawer according to claim 8, wherein said mounting section of each said side wall includes at least one aperture and said hooks on said opposite ends of said locking bar project outwardly and vertically so as to be slidable sidewardly into said respective slots on said side walls and engage said side walls with said locking bar by vertical shifting of said locking bar relative to said side walls.

14. A cabinet drawer according to claim 13, wherein said locking bar is shiftable in a first direction to engage said hooks with said apertures of said side walls.

15. A cabinet drawer according to claim 14, wherein said projecting flange is disposed closely adjacent a side of said locking bar facing in a second direction opposite said first direction to prevent vertical shifting of said locking bar in said second direction.

16. A cabinet drawer according to claim 8, wherein said connector section of said bottom wall comprises a downward opening channel, and said wall connector comprises an upwardly extending projection which is insertable from below into said channel to engage said front wall to said bottom wall.

17. A cabinet drawer according to claim 8, wherein said upper front corners of said side walls are deflectable outwardly to permit positioning of said locking bar between said side walls with said hooks in horizontal alignment with said apertures.

18. In a file cabinet including a box-like enclosure having a hollow interior which is open on a front thereof, and at least one drawer slidably received in said hollow interior, comprising the improvement wherein said drawer includes a planar sheet which defines a bottom wall in a center portion thereof and opposite side walls disposed on the opposite sides of said bottom wall, said side walls and said bottom wall being joined together by rearwardly extending foldable sections which define fold lines about which said side walls are foldable upwardly to respective upright positions, said drawer further including a front wall arrangement which is removably engaged with said side walls and encloses a front end of said drawer wherein said side walls are maintained in said upright position by said front wall arrangement, said sheet further defining a back wall which is joined to said bottom wall by a foldable section that extends sidewardly, said sidewardly-extending foldable section defining a fold line about which said back wall is foldable upwardly to a vertical upright position enclosing a back end of said drawer, said back wall including rearwardly extending connector flanges on opposite side edges thereof and said side walls including forwardly opening channels on rear end edges thereof which are adapted to receive said connector flanges therein, said back wall being foldable both forwardly past said upright position and rearwardly back to said upright position to permit insertion of said connector flanges rearwardly into said channels of said side walls, said connector flanges being tight-fittingly engaged within said channels to interlock said back wall and said side walls together wherein said interlocking of said back wall and said side walls is free of separate fasteners.

19. A cabinet drawer according to claim 18, wherein each of said channels defines a vertically elongate opening wherein said opening has a width which corresponds to a thickness of a respective one of said connector flanges such that said respective connector flange is tight-fittingly engaged within said opening.

20. In a storage drawer for use in a cabinet, comprising the improvement wherein said drawer includes a bottom wall and side walls projecting upwardly from opposite sides of said bottom wall, said drawer including a drawer slide adapted to slidably support said drawer in a cabinet, said bottom wall including a connector section proximate a front edge thereof and each of said side walls including at least one mounting section disposed proximate a front end thereof, said drawer including a horizontal locking bar which extends between said mounting sections of said side walls and includes mounting parts on said opposite bar ends which removably engage said mounting sections of said side walls upon vertical displacement of said locking bar from a disengaged position to an engaged position, said drawer further including a front wall which encloses a front end of said drawer, said front wall including a wall connector proximate a bottom edge thereof which engages said connector section of said bottom wall when said front wall is in an inclined position, said connector section and said wall connector when engaged together permitting rearward pivoting of said front wall from said inclined position to a vertical upright position, said front wall includes a stop surface which faces vertically towards an opposing surface of said locking bar and prevents vertical displacement of said locking bar from said engaged position when said front wall is in said upright position.

21. A cabinet drawer according to claim 20, wherein said drawer includes fasteners which engage said front wall to said locking bar to prevent removal of said front wall from said bottom and side walls.

22. A cabinet drawer according to claim 20, wherein said mounting sections of said side walls include apertures through which said mounting parts are received, said side walls being flexible outwardly to permit positioning of said locking bar between said mounting sections and insertion of said mounting parts through said apertures when said side walls are returned to said upright position.

23. A cabinet drawer according to claim 20, wherein said mounting parts comprise hooks which extend sidewardly through said mounting sections and are engaged with said mounting sections upon vertical displacement of said locking bar from said disengaged position to said engaged position.

* * * * *